US007067049B1

(12) United States Patent
Baillargeon et al.

(10) Patent No.: US 7,067,049 B1
(45) **Date of Patent: *Jun. 27, 2006**

(54) FORMULATED LUBRICANT OILS CONTAINING HIGH-PERFORMANCE BASE OILS DERIVED FROM HIGHLY PARAFFINIC HYDROCARBONS

(75) Inventors: David J. Baillargeon, Cherry Hill, NJ (US); Thomas R. Forbus, Jr., Woodstown, NJ (US); Kenneth R. Graziani, Woodbury, NJ (US); Gretchen R. Hall, Mullica Hill, NJ (US); Nancy M. Page, Sewell, NJ (US); Richard F. Socha, Newtown, PA (US)

(73) Assignee: Exxonmobil Oil Corporation, Fairfax, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/498,793

(22) Filed: Feb. 4, 2000

(51) Int. Cl.
*C10M 101/00* (2006.01)

(52) U.S. Cl. ..... 208/18; 508/110; 585/13

(58) Field of Classification Search ..... 208/18; 508/110; 585/13
See application file for complete search history.

(56) References Cited

U.S. PATENT DOCUMENTS

| | | | | |
|---|---|---|---|---|
| 4,500,417 | A | 2/1985 | Chen et al. | 208/111 |
| 4,704,491 | A | 11/1987 | Tsutsui et al. | 585/10 |
| 4,827,064 | A | 5/1989 | Wu | 585/10 |
| 4,906,350 | A | 3/1990 | Lucien et al. | 208/197 |
| 4,943,672 | A | 7/1990 | Hamner et al. | 585/737 |
| 4,992,183 | A | 2/1991 | Beimesch et al. | 252/32.7 E |
| 5,059,299 | A | 10/1991 | Cody et al. | 208/27 |
| 5,107,054 | A | 4/1992 | Del Rossi et al. | 585/739 |
| 5,135,638 | A | 8/1992 | Miller | 208/27 |
| 5,246,566 | A | 9/1993 | Miller | 208/27 |
| 5,282,958 | A | 2/1994 | Santilli et al. | 208/111 |
| 5,306,860 | A | 4/1994 | Bigeard et al. | 585/737 |
| 5,362,378 | A | 11/1994 | Borghard et al. | 208/138 |
| 5,366,658 | A | 11/1994 | Hoppe et al. | 252/56 S |
| 5,595,966 | A | 1/1997 | Rees et al. | 508/591 |
| 5,789,355 | A | 8/1998 | Adams et al. | 508/241 |
| 5,833,839 | A | 11/1998 | Wittenbrink et al. | 208/112 |
| 5,874,389 | A | 2/1999 | Boden et al. | 508/221 |
| 5,906,727 | A | 5/1999 | Wittenbrink et al. | 208/14 |
| 6,008,164 | A | 12/1999 | Aldrich et al. | 508/110 |
| 6,080,301 | A | 6/2000 | Berlowitz et al. | 208/18 |
| 6,090,989 | A | 7/2000 | Trewella et al. | 585/13 |
| 6,093,861 | A * | 7/2000 | Muntz | 585/13 |
| 6,096,940 | A | 8/2000 | Wittenbrink et al. | 585/750 |

FOREIGN PATENT DOCUMENTS

| | | |
|---|---|---|
| EP | 0 468 109 A1 | 1/1992 |
| EP | 0 552 554 A1 | 7/1993 |
| EP | 0 558 835 A1 | 9/1993 |
| EP | 0 572 866 A1 | 12/1993 |
| EP | 0 776 959 A2 | 6/1997 |
| FR | 2 675 812 | 10/1992 |
| JP | 5 86389 | 4/1993 |

(Continued)

*Primary Examiner*—Ellen M. McAvoy
(74) *Attorney, Agent, or Firm*—Malcolm D. Keen; Mark D. Marin

(57) ABSTRACT

The present invention relates to formulated lubricant oils derived from a highly paraffinic basestock. The lubricating oils of the present invention achieve the extremely stringent viscosity requirements of SAE "0W" crossgraded engine oils and demonstrate an excellent combination of low-temperature performance and biodegradability not achievable by other formulations derived from other classes of basestocks.

42 Claims, 4 Drawing Sheets

FOREIGN PATENT DOCUMENTS

| | | |
|---|---|---|
| WO | WO 97/21788 | 6/1997 |
| WO | WO 99 41332 | 2/1999 |
| WO | 9920720 | 4/1999 |
| WO | WO/99/20720 | 4/1999 |

* cited by examiner

FIGURE 1. Low-Temperature CCS Viscosity Comparison
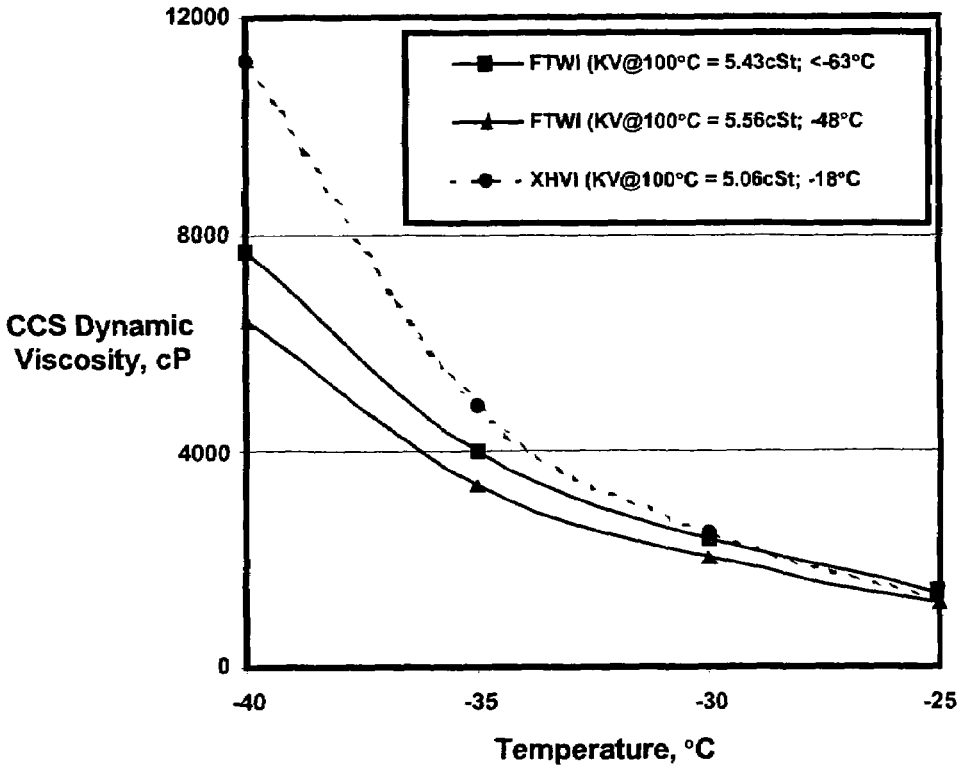

FIGURE 2. Unique Lube Compositions
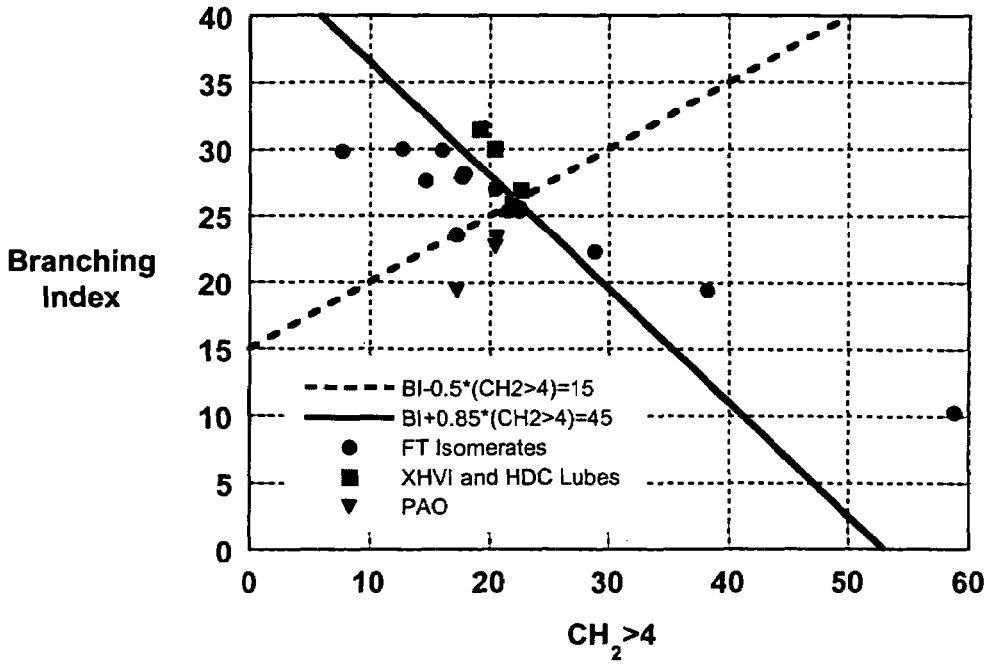

FIGURE 3. High/Low-Temperature Viscosity Relationship
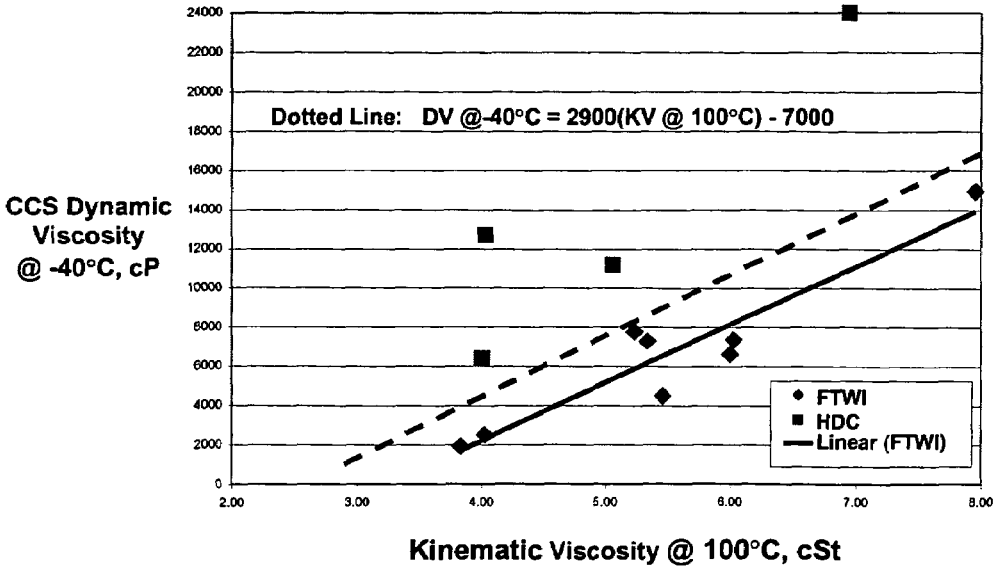

FIGURE 4. VI, Low-Temp Viscosities vs Pour Point
(Wax Isomerates 6 cSt @ 100°C)
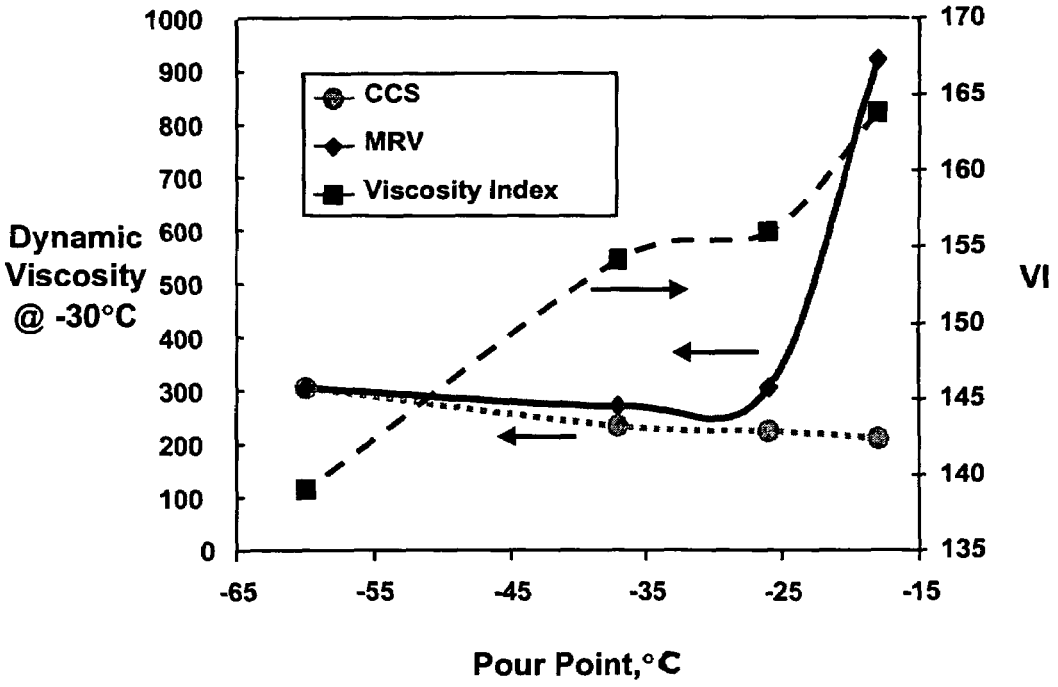

FORMULATED LUBRICANT OILS CONTAINING HIGH-PERFORMANCE BASE OILS DERIVED FROM HIGHLY PARAFFINIC HYDROCARBONS

FIELD OF THE INVENTION

The present invention relates to formulated lubricant oils possessing a combination of excellent low temperature performance and biodegradability.

BACKGROUND OF THE INVENTION

High performance formulated lubricants depend heavily on the performance characteristics of component base oils (or basestocks) used in blending such products. One traditional problem regarding lubricant oil performance is that of achieving a useable balance of both low-temperature and high-temperature properties. For example, modern multi-grade engine oils demand significant performance both at low temperature (for cold engine starts and oil pumpability) as well as at high temperature (viscosity retention, resistance to oxidation and thermal degradation). The trend to SAE "0W" grade engine oils, for example, which require superior low temperature flow properties, increases the demand for lubricants having improved combination of low-temperature and high-temperature performance.

Indeed, the viscosity-temperature relationship of the oil is one of the critical criteria which must be considered when selecting a lubricant for a particular application. For example, the viscosity requirements for qualifications as multi-grade engine oils are described by the SAE Engine Oil Viscosity Classification-SAE J300. These standards apply to both passenger care engine oils (PCEO) and commercial engine oils (CEO). The high-temperature (100° C.) viscosity is measured according to ASTM D445, Method of Test for Kinematic Viscosity of Transparent and Opaque Liquids, and the results are reported in centistokes (cSt). The HTHS viscosity, or high-temperature (150° C.) high-shear ($10^6$ $s^{-1}$) viscosity, is measured according to ASTM D4683, Test Method for Measuring Viscosity at High Temperature and High Shear Rate by Tapered Bearing Simulator, and the results are reported in centipoise (cP). The low-temperature (W) viscosity requirements are determined by ASTM D 5293, Method of Test for Apparent Viscosity of Motor Oils at Low Temperature Using the Cold Cranking Simulator (CCS), and the results are reported in centipoise (cP). A second low-temperature viscosity requirement, simulating low-temperature pumping conditions, is determined by MRV (mini rotary viscometer), ASTM D4684, Method for Determination of Yield Stress and Apparent Viscosity of Engine Oils at Low Temperature, with yield stress reported in pascals (Pa) and viscosity reported in centipoise (cP). In addition, a low-temperature pumpability requirement is imposed on multigrade oils, as determined by MRV. It should be noted that CCS viscosity (measured under high energy, high shear conditions) and MRV viscosity (measured under low energy, low shear conditions) are different low-temperature physical properties of lube base oils, and each measures a different characteristic of lube waxiness. Formulated passenger car engine oils must simultaneously meet both critical low-temperature properties of CCS viscosity and MRV viscosity. Table 1 (below) outlines the high- and low-temperature requirements for the recognized SAE grades for engine oils.

TABLE 1

Engine Oil Viscosity Grade Specifications (SAE J300)

| SAE Grade | Low-Temperature Viscosities: CCS Viscosity (cP) | Low-Temperature Viscosities: MRV Viscosity (cP) | High-Temperature Viscosities: Kinematic Viscosity at 100° C. (cSt) Min | Max. | HTHS Viscosity (cP) |
|---|---|---|---|---|---|
| 0 W | 3250 at −30° C. | 60000 at −40° C. | 3.8 | | |
| 5 W | 3500 at −25° C. | 60000 at −35° C. | 3.8 | | |
| 10 W | 3500 at −20° C. | 60000 at −30° C. | 4.1 | | |
| 15 W | 3500 at −15° C. | 60000 at −25° C. | 5.6 | | |
| 20 W | 4500 at −10° C. | 60000 at −20° C. | 5.6 | | |
| 25 W | 6000 at −5° C. | 60000 at −15° C. | 9.3 | | |
| 20 | | | 5.6 | <9.3 | 2.6 min |
| 30 | | | 9.3 | <12.5 | 2.9 min |
| 40 | | | 12.5 | <16.3 | 2.9 min (PCEO) |
| 40 | | | 12.5 | <16.3 | 3.7 min (CEO) |
| 50 | | | 16.3 | <21.9 | 3.7 min |
| 60 | | | 21.9 | <26.1 | 3.7 min |

The SAE J300 viscosity grades as well as viscosity grades reaching lower or higher than those defined by SAE J300 are encompassed by this specification.

In a similar manner, SAE J306c describes the viscometric qualifications for axle and manual transmission lubricants. High temperature (100° C.) viscosity measurements are performed according to ASTM D445. The low temperature viscosity values are determined according to ASTM D2983, Method of Test for Apparent Viscosity at Low Temperature Using the Brookfield Viscometer and these results are reported in centipoise (cP). Table 2 summarizes the high- and low-temperature requirements for qualification of axle and manual transmission lubricants.

TABLE 2

Axle/Transmission Oil Viscosity Specifications

| SAE Viscosity Grade | Maximum Temperature for Viscosity of 150,000 cP (° C.) | Kinematic Viscosity at 100° C. (cSt) Min | Max |
|---|---|---|---|
| 70 W | −55 | — | |
| 75 W | −40 | 4.1 | |
| 80 W | −26 | 7.0 | |
| 85 W | −12 | 11.0 | |
| 90 | — | 13.5 | 24.0 |
| 140 | — | 24.0 | 41.0 |
| 250 | — | | |

In addition to the viscosity temperature relationship, other properties are, of course, required for an engine oil including, but not limited to, resistance to oxidation under the high temperatures encountered in the engine, resistance to hydrolysis in the presence of the water produced as a combustion product (which may enter the lubricating circulation system as a result of ring blow-by), and since the finished oil is a combination of basestock together with additives, these properties should inhere in all of the components of the oil so that the final, finished lubricant possesses the desired balance of properties over its useful life.

High performance lubricant products with the desired range of low-temperature and high-temperature performance properties may be achieved by formulating with synthetic base oils, including polyalphaolefins (PAO). Synthetic base oils such as PAO are highly advantageous in formulating high-performance lubricants, with desirable low-temperature and high-temperature performance properties. In particular, PAO have especially exhibited excellent low-temperature performance due to its chemical structure and to a composition which contains no waxy hydrocarbon components. One problem with PAO fluids, however, is that they are generally resistant to easy biodegradation due to their chemical structure. In the event of a release, lubricating oils, including engine oils, gear oils, and transmission oils, may persist long enough to disturb the natural state of the environment. Having high rates of biodegradation is advantageous in the event of such a lubricant release into the environment.

Finished lubricants may also be formulated with high-quality hydroprocessed base oils. Hydroprocessed base oils, however, have traditionally demonstrated poorer low-temperature properties and performance than synthetic base oils such as PAO. Accordingly, lube products formulated with hydroprocessed base oils have had problems in achieving the low-temperature performance of lube products formulated with PAO base oils. On the other hand, certain hydroprocessed base oils have demonstrated good biodegradability, especially when compared to that of synthetic base oils like PAO.

WO 97/21788 discloses biodegradable hydroprocessed base oils with pour points of −15° C. to −24° C., with 6.0–7.5 methyl branches per 100 carbons for a hydrocarbon fraction with a boiling point above 700° F., and with 6.8–7.8 methyl branches per 100 carbons for a typical 100N base oil.

U.S. Pat. No. 5,366,658 discloses biodegradable base oils for lubricants and functional fluids comprising polymethylalkanes, having terminal methyl groups and having methylene and ethylidene groups. Because of the highly specific synthesis schemes used in making these polymeric fluids, the structure of the polymethylalkanes is highly constrained with branches along the hydrocarbon polymer backbone being exclusively single-carbon ($C_1$) methyl groups. This structure type is different from that possessed by the wax isomerate fluids, in which the branching groups along the long-chain hydrocarbon backbone include not only methyl ($C_1$) but also ethyl ($C_2$), propyl ($C_3$), butyl ($C_4$), and possibly other longer hydrocarbon groups. Such mixtures of branching groups, with differing chain lengths/sizes, impart performance characteristics to long-chain hydrocarbons that are different from the performance features imparted by only methyl ($C_1$) branches.

U.S. Pat. No. 5,595,966 and EP 0468109A1 both disclose substantially biodegradable hydrogenated polyalphaolefin (PAO) fluids, which demonstrate from 20% and to at least 40% biodegradation in the CEC L-33-T-82 test. EP 0558835A1 discloses substantially biodegradable unhydrogenated PAO fluids, which demonstrate from 20% to at least 50% biodegradation in the CEC L-33-T-82 test. The PAO's of these references have a chemical structure consisting of a short-to-moderate chain length hydrocarbon backbone with only a few long-chain pendant groups attached.

Normally, a finished lubricant will contain several lubricant components, both base oil(s) and performance additive(s), in order, for example, to achieve desired performance requirements. The development of a balanced lubricant formulation involves considerably more work than the casual use of performance additive(s) in combination with base oil(s). Quite often, functional difficulties may arise from combinations of these materials with certain base oils during actual operating conditions, and unpredictable antagonistic or synergistic effects may become evident. Thus, obtaining suitable formulations require extensive testing and experimentation. Likewise, subtle features of a base oil's chemical composition may significantly influence a base oil's performance in a formulated lubricant. Therefore, matching base oil technology with additive technology is not a routine exercise.

It has now been discovered that certain wax-isomerate basestocks of the present invention demonstrate unusually good low-temperature and high-temperature properties which allow unusually broad formulation flexibility compared to traditional hydroprocessed base oils. For example, these formulated wax-isomerate type lubricants can meet the extremely stringent viscosity requirements of SAE "0W", particularly SAE 0W-40 crossgraded engine oils, whereas typical hydroprocessed oils with compositions outside the defined compositional range of the present invention cannot reach such a wide crossgrade. Achieving SAE "0W-XX" crossgrades (e.g. XX=20, 30, 40, 50, 60) is of particular utility because such lubricant formulations are known to have improved fuel economy performance over comparable 5W-XX and higher "W" viscosity grades. Such formulation flexibility at both low and high temperatures is typical of premium synthetic PAO basestocks. In addition, the wax-isomerate derived base oils of this invention unexpectedly demonstrate very good biodegradability, especially when compared to PAO base oils.

SUMMARY OF THE INVENTION

In accordance with the present invention, it has now been found that certain wax isomerate basestocks with unexpectedly good biodegradability and viscometric characteristics may be combined with other suitable lubricating oil components to yield fully formulated, biodegradable, multigrade lubricating oils. The performance characteristics of such formulated lubricant products are unexpected, combining the biodegradability typically expected of hydroprocessed lubricants (but not of PAO-type oils) with the wide temperature performance range typically expected of PAO-type lubricants (but not that of conventional hydroprocessed oils).

The formulated lubricant oils of the present invention comprise a wax isomerate paraffinic hydrocarbon basestock component in which the extent of branching, as <<measured by the percentage of methyl hydrogens (BI), and the proximity of branching, as measured by the percentage of recurring methylene carbons which are four or more carbons removed from an end group or branch ($CH_2$>4), are such that:

$$BI-0.5(CH_2>4)>15; \text{ and} \quad (a)$$

$$BI+0.85(CH_2>4)<45; \quad (b)$$

as measured over the hydrocarbon basestock as a whole. Preferably, the wax isomerate basestocks to be used in the lubricating oils of the present invention have a biodegradability value of at least 50% under the OECD 301B test. In addition, these basestock components have pour points of about −25° C. or lower.

The formulated lubricant oils comprising these same paraffinic basestock components are also characterized by unexpectedly good low-temperature and high-temperature viscosities, with CCS viscosity at −15° C. of not more than about 3500 cP, and with a kinematic viscosity at 100° C. of about 5 cSt or greater. Desirable multigraded oils obtained using these basestocks may include 0W-, 5W-, 10-, and 15W-XX grades (XX=20–60), and more specifically, for example, SAE 0W-30, 0W-40, and 15W-50.

BRIEF DESCRIPTION OF THE DRAWINGS

FIG. 1 compares the low-temperature CCS viscometric properties of the primary liquid hydrocarbon basestocks (e.g. FTWI, or Fischer-Tropsch Wax Isomerate) of the present invention with typical hydroprocessed lubricant basestocks.

FIG. 2 illustrates the parameters of BI (branching index) and $CH_2$>4 (branching proximity, defined as a percentage), as set forth in formulas (a) and (b), of the wax-isomerate basestock compositions disclosed herein.

FIG. 3 is a comparison of dynamic viscosities (DV@−40° C.), as measured by CCS method ASTM D5392, and kinematic viscosities (KV(100° C.) of various hydrocarbon fluids, including, e.g., conventional hydrocracked stocks, indicated as HDC, and FTWI basestocks of the present invention. The solid line represents the viscosity trend of the FTWI basestocks of this invention. The dotted line (parallel to the FTWI trend line) represents a boundary between the dynamic viscosity of the HDC oils and that of the FTWI oils.

FIG. 4 illustrates the low-temperature viscosity (MRV and CCS) plus viscosity index (VI) for a typical series of basestocks utilized in the present invention. In this illustration, the basestocks are matched in viscosity at 6 cSt at 100° C., but differ from one another in pour point.

DETAILED DESCRIPTION OF THE INVENTION

The particular wax isomerate basestocks described herein broadly encompass basestocks which may be used in lubricant formulations. Surprisingly, the compositions of the wax isomerate basestocks as described herein generally do not predict the suitability of these same basestocks as lubricant components in the formulated lubricants of this invention. Rather, additional performance limits (e.g. basestock performance properties such as pour point, MRV viscosity, MRV yield stress, and viscosity index) must also be considered in identifying suitable wax isomerate basestocks which could be used in the lubricant formulations described herein.

Additionally, the suitability of the wax isomerate basestocks defined herein may be further limited by the interaction of such basestocks with other lubricant components (e.g. one or more additives, and optionally other basestocks) and may further be limited by performance of the finished fully formulated lubricant composition. Such performance limitations may include, for example, one or more of the following: CCS viscosity, MRV viscosity, MRV yield stress.

The formulated lubricating oils of the present invention comprise one or more wax isomerate basestocks in combination with other lubricating components. Such formulated oils include numerous functional fluids, including without limitation, engine oils, gear oils, transmission oils, and industrial oils. The present invention will be described with primary reference to engine oils, which represent the prime utility of the invention, but it is also applicable to other classes of oils as noted above.

The formulated lubricants of the present invention are capable of meeting a low-temperature grade of "0W," implying a cold cranking viscosity (ASTM D 5293) of not more than 3250 cP maximum at −30° C. These 0W oils necessarily have a very low viscosity at low temperatures in order to meet the extreme low-temperature fluidity requirement. Since the low viscosity base oils required to meet this portion of the specification have a low viscosity at the 100° C. temperature used for establishing the high-temperature viscosity grade, as well as at actual engine operating temperatures, the 0W cross-graded oil is very difficult to achieve. However, by combining the present components, it has been found possible to produce oils conforming to the 0W requirement. Thus, the excellent low temperature oils of the present invention are 0W grade oils such as 0W-20, 0W-30, and 0W-40.

The advantages of the present invention may also be secured in other oils with a significant low-temperature performance requirement, for example, 5W and 10W oils with a high-temperature grade of 20 or 30 or higher. The utility of the wax isomerates described herein increases as the range of the crossgrade (i.e. difference between low-temperature and high-temperature requirements) gets wider.

Although indicated by a low-temperature performance rating, e.g. 0W or W, the present oils are highly satisfactory under high-temperature operating conditions. In commercial use, the viscosities characteristic of these low-temperature ratings translate into improved fuel economy in actual operation. Thus, in addition to providing ready starting and improved lubrication from start-up, the present oils result in better fuel mileage and overall economy.

The Primary Basestock Component

The primary basestocks of the present invention comprise paraffinic hydrocarbon components in which the extent of branching, as measured by the percentage of methyl hydrogens (BI), and the proximity of branching, as measured by the percentage of recurring methylene carbons which are four or more carbons removed from an end group or branch ($CH_2$>4), are such that:

$$BI-0.5(CH_2>4)>15; \text{ and} \quad (a)$$

$$BI+0.85(CH_2>4)<45; \quad (b)$$

as measured over the hydrocarbon basestock as a whole.

The hydrocarbon fluids of the present invention may have BI greater than 25.4, and Branching Proximity ($CH_2$>4) less than 22.5, but more preferably have BI greater than 26.1 and Branching Proximity ($CH_2$>4) less than 22.2, although any composition meeting the limitations of formula (a) and (b) is intended to be within the scope of the present invention. Measurement of the branching characteristics of the liquid hydrocarbons according to the present invention was performed by nuclear magnetic resonance (NMR) analysis, and is described in more detail below.

In one preferred embodiment, the basestock that forms a primary component of the lubricating oils of the present invention comprises a novel hydrocarbon composition described in co-pending Ser. No. 09/170,683, corresponding to international publication number WO 99/20720, incorporated herein by reference. In a preferred embodiment, the hydrocarbon composition is produced by the isomerization of Fischer Tropsch waxes. Accordingly, the basestocks may be referred to herein as wax isomerate basestocks, but are not necessarily limited to such basestocks, as any basestock meeting the compositions defined by equations (a) and (b) may be used. For example, while it is preferable to produce the liquid hydrocarbon basestocks used in the present invention from Fischer-Tropsch-derived raw materials, other waxy hydrocarbon materials, such as conventional waxy lube raffinates, slack waxes, deoiled slack waxes, foots oils and lube distillate hydrocrackates may be used to produce the primary hydrocarbon basestocks described in the present invention.

The process of making the lubricant oil basestocks of the present invention may be characterized as a hydrodewaxing process. The hydrodewaxing process may be conducted over a combination of catalysts, or over a single catalyst. Conversion temperatures may range from about 200° C. to about 500° C. at pressures ranging from about 500 to 20,000 kPa. This process is operated in the presence of hydrogen, and hydrogen partial pressures will normally be from 600 to 6000 kPa. The ratio of hydrogen to the hydrocarbon feedstock (hydrogen circulation rate) will normally be from 10 to 3500 $n.l.l.^{-1}$ (56 to 19,660 SCF/bbl) and the space velocity of the feedstock will normally be from 0.1 to 20 LHSV, preferably 0.1 to 10 LHSV.

Hydrocarbon conversion catalysts useful in the conversion of the waxy feedstocks disclosed herein to form the hydrocarbon components of the present invention are zeolite catalysts, such as ZSM-5, ZSM-11, ZSM-23, ZSM-35, ZSM-12, ZSM-38, ZSM-48, offretite, ferrierite, zeolite beta, zeolite theta, zeolite alpha, as disclosed in U.S. Pat. No. 4,906,350. These catalysts are used in combination with Group VIII metals, in particular palladium or platinum. The Group VIII metals may be incorporated into the zeolite catalysts by conventional techniques, such as ion exchange.

In one preferred embodiment, conversion of the waxy feedstock may be conducted over a combination of Pt/zeolite beta and Pt/ZSM-23 catalysts in the presence of hydrogen. In another embodiment, the process of producing the lubricant oil basestocks comprises hydroisomerization and dewaxing over a single catalyst, such as Pt/ZSM-35. In either case, the unique products of the present invention may be obtained.

The resulting liquid hydrocarbon basestocks are conveniently characterized by pour point, one of several key physical and chemical properties described herein. Pour point may be measured according to ASTM method D97, Test Method for Pour Points of Petroleum Products, and is reported in ° C. However, the preferred technique for pour point is the automated method ASTM D5950, Test Method for Pour Point of Petroleum Products (Automatic Tilt Method), with pour points reported in ° C.

The liquid hydrocarbon basestocks of the present invention may have very low concentration levels of typical contaminants found in lube oil basestocks refined from natural mineral oils, depending upon the nature of the feedstock used to produce the liquid hydrocarbons. Typically, the liquid hydrocarbon compositions of the present invention have less than 0.1 wt % aromatic hydrocarbons, less than 20 ppm by weight of nitrogen-containing compounds, less than 20 ppm by weight of sulfur-containing compounds and low levels of naphthenic hydrocarbons, i.e. cycloparaffins. The concentration levels of both sulfur and nitrogen compounds in these hydrocarbon compositions, when derived from Fischer Tropsch waxes, are preferably less than 10 ppm each, and more preferably less than 1 ppm each. Thus, it is preferred to produce the liquid hydrocarbon basestocks of the present invention from Fischer-Tropsch-derived materials in order to obtain the very low level of contaminants in the product fluids.

On average, the primary liquid hydrocarbon compositions of the present invention are paraffinic hydrocarbon components having fewer than 10 hexyl- or longer branches per 100 carbon atoms. The hydrodewaxing step used to produce the liquid hydrocarbons of the present invention results in significant levels of isomerization of the long chain paraffins in the waxy feedstocks, resulting in paraffinic hydrocarbon components with a plurality of branches, as described in formulas (a) and (b).

As noted above, the primary hydrocarbon basestocks of the present invention comprise a major component of the formulated lubricating oils of the present invention and may be used in combination with other lubricating oil basestocks, such as for example mineral oils, polyalphaolefins, esters, polyalkylenes, alkylated aromatics, hydrocrackates and solvent-refined basestocks.

The primary lubricant oil basestocks of the present invention contain primarily isoparaffinic components with nominal boiling points of 370° C. or more and are unusual in that they unexpectedly exhibit a unique combination of both high viscosity indices and extremely low pour points. These two characteristics are generally known in the art to be related in direct proportion, i.e. lowering the pour point of a hydrocarbon fluid results in decreasing the viscosity index, and therefore it is quite unusual to obtain both an extremely low pour point and a relatively high VI in the same fluid. For example, conventional mineral oil basestocks, such as Comparative Examples 3–5 herein, exhibit relatively low VI's when pushed into the low pour point ranges (Table 3).

However, the primary basestocks of the present invention are characterized by low pour points of less than or equal to −18° C., preferably less than or equal to −25° C. and more preferably less than or equal to −30° C., with kinematic viscosities (KV) ranging from about 2.0 cSt to greater than about 13 cSt, preferably about 4 cSt to about 10 cSt, at 100° C. and high viscosity indices (VI) from about 120 to about 160, preferably from about 130 to about 160 and more preferably from about 140 to about 160, as well as BI and $CH_2$>4 values as set forth in formulas (a) and (b), above.

In particular, preferred wax isomerate lubricant basestocks have a combination of VI and pour point from about 130 VI/−66° C. to about 160 VI/−20° C. and more preferably from about 140 VI/−55° C. to about 160 VI/−25° C.

An upper VI limit of about 160 is particularly notable because as VI values increase beyond 160, the basestock's MRV viscosity begins rapidly increasing (FIG. 4), and may reach levels which could render such basestocks unsuitable for formulating multi-grade engine oils. Waxy hydrocarbons in lube base stocks directly influence low-temperature lube properties, and MRV is significantly sensitive to waxiness, due to the long cooling cycle and the low-shear used by the test procedure. The presence of even small amounts of waxy hydrocarbons in the wax isomerate basestock can have a major negative impact on MRV viscosity and MRV yield stress (respectively, limits of 60000 cP max, and 35 Pa max).

An unexpected advantage was also found for finished oils formulated with wax-isomerate base oils having pour points in a range of approximately −30° C. to about −45° C. compared to base oils with pour points below about −45° C., for example about −60° C. or lower, pour points. Note in FIG. 4 that CCS viscosity unexpectedly increases as basestock pour point decreases, over the range of about −20° C. to about −60° C. and lower. At comparable wax isomerate base oil viscosity, a finished lube formulated with a wax isomerate base oil having a pour point from about −30° C. to −45° C. demonstrates a more beneficial, lower CCS viscosity than that of an analogous finished lube formulated with an isomerate base oil component having a pour point less than −45° C. For example, a comparison of Examples 18 and 17 (Table 13) using base oils B-1 (−34° C. pour) versus A-2 (−49° C. pour), respectively, shows that Example 18 achieves a lower and more advantageous CCS viscosity than Example 17. The lower CCS viscosity of the formulated lube containing the higher pour point base oil permits increased flexibility in achieving the industry targets which specify maximum permissible CCS viscosity limits for formulated oils according to viscosity grade.

Among the other advantages of this invention is the surprisingly good biodegradability of the primary base oils utilized in the present lubricating oil formulations, together with the combination of desirable low temperature properties they possess. Moreover, the formulated lubes derived from certain wax isomerate base oils can simultaneously exceed the blending (viscometric) flexibility of typical hydroprocessed base oils, as well as surpass the biodegradation performance of typical PAOs.

Wax isomerate base oil biodegradation was measured by both OECD 301B and CEC L-33-A-93 test methods. Both tests are described briefly below.

The OECD 301B modified Sturm $CO_2$ Test Method is a test method developed by the Organization for Economic Cooperation and Development and reported in "OECD Guidelines for the Testing of Chemicals," Vol. 2, Section 3, pp. 18–24 (Adopted Jul. 17, 1992), and is incorporated herein by reference. This test measures the aerobic microbial biodegradation of a test material by its complete breakdown to carbon dioxide.

According to OECD 301B, in general, the biodegradability of a test material over a 28-day period is determined by measuring the evolution of carbon dioxide from the microbial oxidation of the test material's organic carbon. The carbon dioxide produced is trapped in barium hydroxide solution and is quantified by titration of residual hydroxide with standardized HCl. To determine the percent biodegradation, the amount of $CO_2$ produced microbially from the test material is compared to its theoretical carbon dioxide (the complete oxidation of the carbon in the test material to $CO_2$). Positive controls, using sodium benzoate as reference material, are run to check the viability of the aerobic microorganisms used in the procedure. Blank controls are also run in parallel. Tests, controls, and blanks are run in duplicate.

The CEC L-33-A-93 Test Method is a test method developed by the Coordinating European Council (CEC) and reported in "Biodegradability of Two-Stroke Cycle Outboard Engine Oils in Water," 38 pages (issued Feb. 21, 1995) and incorporated herein by reference. This test measures the decrease in the amount of the parent material due to microbial action.

According to CEC L-33-A-93, in general, primary biodegradability of a test material is determined as follows: an aqueous mineral medium solution and a known amount of the test material are incubated with an inoculum of unacclimated aerobic microorganisms from sewage. The test material is the nominal sole source of carbon. The test system is incubated at a constant temperature with continuous agitation in the dark over a period of 21 days. A poisoned reference mixture containing mineral medium solution, the test material, and mercuric chloride (to inhibit microbial activity) is also run in parallel. Tests and references are done in triplicate. Primary biodegradation of the test material is determined by quantifying (via extraction, and infrared spectral analysis) the amount of unchanged parent material remaining at the end of 21 days.

The biodegradation characteristics of certain wax isomerate basestocks of the present invention are referenced in Table 9 below. These wax isomerate basestocks are significantly more biodegradable than the PAO lube basestocks. In addition, these same wax isomerate basestocks are generally more biodegradable than conventional hydroprocessed basestocks, as exemplified by the Shell XHVI and the Chevron UCBO oils.

The primary hydrocarbon basestocks utilized in the present formulations typically have a biodegradability of greater than 50% under the OECD 301B test, preferably about 60% or greater, and more preferably about 65% or greater.

The hydrocarbon basestocks of the present invention typically comprise from about 10 to about 99.5 wt % of the total formulation, preferably from about 40 to about 95 wt %, and more preferably from about 60 to about 90 wt %. It is to be recognized that the percentage of the wax isomerate basestocks in conjunction with the other lubricating oil components may be varied depending on the particular formulation performance requirements desired.

Other Lubricant Oil Components

In addition to the primary basestocks described above, the oil formulations of the present invention comprise numerous other components in order to achieve the desired combination of properties in the finished lubricant. The other lubricant oil components may comprise, without limitation, other optional base oils, performance polymers, viscosity modifier polymers, performance additives, and performance additive packages. The proper selection of these other components is important to impart the necessary characteristics associated with the various multigrade service requirements.

Optional Basestocks

For example, the lubricants of the present invention may comprise optional basestocks, such as mineral oils and, in particular, synthetic basestocks. The mineral-derived basestocks may include typical light neutral oils, and synthetic basestocks may include, for example, polyalpha olefins, alkyl aromatics and esters. Synthetic hydrocarbon basestocks are preferred, especially the PAOs with viscosities in the range of 1.5 to 12 cSt, generally with VI's of 120 or greater, either in the form of single component or blended PAOs. Optionally, other hydrocarbon basestocks (mineral-derived or synthetic) with high viscosity, up to 3000 cS or more at 100° C., may also be used. As alternatives, other synthetic basestocks may be used, for example, alkylbenzenes, and other alkylated aromatics such as alkylated naphthalene, alkylated diphenyl ethers, alkylated diphenyl sulfides, and alkylated diphenyl methanes, as well as the synthetic basestocks described in "*Synthetic Lubricants*," Gunderson and Hart, Reinhold Publ. Corp., New York 1962. Other alternatives may also include esters, for example, with mono-, di-, tri-, or tetra-carboxylate functionality.

The Poly Alpha Olefins (PAOs) typically comprise relatively low molecular weight hydrogenated polymers or oligomers of alphaolefins which include but are not limited to $C_2$ to about $C_{32}$ alphaolefins with $C_8$ to about $C_{16}$ alphaolefins, such as 1-octene, 1-decene, 1-dodecene, and the like, being preferred. The preferred polyalphaolefins are poly-1-decene and poly-1-dodecene, although the dimers of higher olefins in the range of $C_4$ to $C_{18}$ may be used to provide low viscosity basestocks of acceptably low volatility. The PAOs in the viscosity range of 1.5 to 12 cSt, are generally predominantly trimers and tetramers of the starting olefins, with minor amounts of the higher oligomers, depending on the exact viscosity grade and the starting oligomer.

The PAO fluids may be conveniently made by the polymerization of an alphaolefin in the presence of a polymerization catalyst, such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. No. 4,149,178 or U.S. Pat. No. 3,382,291 may be conveniently used herein. Other descriptions of PAO synthesis are found in the following U.S. Pat. No. 3,742,082 (Brennan); U.S. Pat. No. 3,769,363 (Brennan); U.S. Pat. No. 3,876,720 (Heilman); U.S. Pat. No. 4,239,930 (Allphin); U.S. Pat. No. 4,367,352 (Watts); U.S. Pat. No. 4,413,156 (Watts); U.S. Pat. No. 4,434,408 (Larkin); U.S. Pat. No. 4,910,355 (Shubkin); U.S. Pat. No. 4,956,122 (Watts); U.S. Pat. No. 5,068,487 (Theriot). The dimers of the $C_{14}$ to $C_{18}$ olefins are described in U.S. Pat. No. 4,218,330.

In addition, other basestocks may also be combined with the primary hydrocarbon basestocks defined in the present invention. For example, it may be desirable to utilize one or more other components which possess additional chemical functionality (e.g. aromatic, ester, ether, alcohol, etc.) in order to confer additional desired characteristics, such as, for example, additive solvency and seal compatibility, to the finished lubricant. Certain additives used in oils contain aromatic groups, and for adequate solvency, some aromatic character in the basestock may be required, even though aromatics, generally, do not lead to optimum lubricant performance in themselves. In addition, additive solvency and seal compatibility characteristics may be secured by the use of ester basestocks.

In alkylated aromatic stocks, the alkyl substituents are typically alkyl groups of about 8 to 25 carbon atoms, usually from 10 to 18 carbon atoms and up to three such substituents may be present, as described for the alkyl benzenes in ACS Petroleum Chemistry Preprint 1053–1058, "*Poly n-Alkylbenzene Compounds: A Class of Thermally Stable and Wide Liquid Range Fluids*", Eapen et al., Phila. 1984. Tri-alkyl benzenes may be produced by the cyclodimerization of 1-alkynes of 8 to 12 carbon atoms as described in U.S. Pat. No. 5,055,626. Other alkylbenzenes are described in EP 168534 and U.S. Pat. No. 4,658,072. Alkylbenzenes have been used as lubricant basestocks, especially for low-temperature applications (e.g., Arctic vehicle service and refrigeration oils) and in papermaking oils; they are commercially available from producers of linear alkylbenzenes (LABs). The linear alkylbenzenes typically have good low pour points and low-temperature viscosities and VI values greater than 100 together with good solvency for additives. Other alkylated, multi-ring aromatic compounds may also be suitable as lubricant components for this invention, such as for example alkylated naphthalene. An example of such an alkyl naphthalene may be further described as having a mono alkyl substituent group of about 10 to about 20 carbon atoms having a kinematic viscosity at 100° C. of about 2 cSt to about 8 cSt. Other alkylated aromatics which may be used when desirable are described, for example, in "*Synthetic Lubricants and High Performance Functional Fluids*", Dressler, H., chap 5, (R. L. Shubkin (Ed.)), Marcel Dekker, N.Y. 1993.

Esters which may be useful as lubricant basestocks may contain mono-, di-, tri-, or tetra-carboxylate functionality. Such esters basestocks may include esters of dibasic acids with monoalkanols and the polyol esters of monocarboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols such as the neopentyl polyols, e.g. neopentyl glycol, trimethylol ethane, 2-methyl-2-propyl-1,3-propanediol, trimethylol propane, pentaerythritol and dipentaerythritol; with alkanoic acids containing at least 4 carbon atoms, normally the $C_5$ to $C_{30}$ acids, such as the saturated straight chain fatty acids including caprylic acid, capric acid, lauric acid, myristic acid, palmitic acid, stearic acid, arachic acid, and behenic acid, or the corresponding branched chain fatty acids or the unsaturated fatty acids such as oleic acid.

Other suitable synthetic ester components are the esters of trimethylol ethane, trimethylol propane, trimethylol butane, pentaerythritol and/or dipentaerythritol with one or more monocarboxylic acids containing from about 5 to about 10 carbon atoms, which are widely available commercially.

The ester components typically have a kinematic viscosity at 100° C. of about 2 cSt to about 20 cSt, more preferably about 2 cSt to about 8 cSt.

The optional basestock component of the present invention will typically be from about 0 to about 50 wt % of the total lubricant composition (all proportions and percentages set out in this specification are by weight unless the contrary is stated) and more usually in the range of about 5 to about 20 wt %.

Viscosity Modifier Polymer (Polymeric Thickener)

The lubricant compositions may also include a relatively high molecular weight component which has a marked viscosity thickening property when blended with the other components of the basestock. Such high molecular weight materials are generally polymeric materials, known alternatively as viscosity modifier polymers, polymeric thickeners, or viscosity index improvers. These polymeric components typically have a molecular weight from about 10,000 to 1,000,000, normally in the range of 100,000 to 1,000,000. Such polymeric components may include, for example, hydrogenated styrene-isoprene block copolymers, rubbers based on ethylene and propylene, high molecular weight acrylate or methacrylate esters, polyisobutylenes, and other materials of high molecular weight which are soluble in the basestocks and which, when added to the basestocks, confer the required viscosity to achieve the desired high-temperature viscosity grade e.g. 20, 30, 40, 50, 60, or higher.

In some instances, the formulated lubricants of this invention may not include viscosity modifier polymers. Using the wax isomerates described herein, narrowly crossgraded lubricants are achievable. For example, liquid lubricant compositions containing no viscosity modifier polymer may conform to the SAE "xW-y" viscosity grading, where x=0, 5, 10, or 15, and where y=10, 20, 30, or 40, and where (y−x) is less than or equal to 25.

However, in many cases, viscosity modifier polymers in combination with lower viscosity basestocks have been found to be highly advantageous in achieving desired viscometric targets, particularly with multigrade lubricant oils. These polymer materials are readily available commercially from a number of suppliers according to type.

The preferred polymeric materials of this class for use in the present formulations are the block copolymers produced by the anionic polymerization of unsaturated monomers including styrene, butadiene, and isoprene. Copolymers of this type are described in U.S. Pat. Nos. 5,187,236; 5,268,427; 5,276,100; 5,292,820; 5,352,743; 5,359,009; 5,376,722 and 5,399,629. Block copolymers may be linear or star type copolymers and for the present purposes, the linear block polymers are preferred. The preferred polymers are the isoprene-butadiene and isoprene-styrene anionic diblock and triblock copolymers. Particularly preferred high molecular weight polymeric components are the ones sold under the designation Shellvis™ 40, Shellvis™ 50 and Shellvis™ 90 by Shell Chemical Company, which are linear anionic copolymers. Of these, Shellvis™ 50, which is an anionic diblock copolymer, is preferred. A less preferred class of anionic block copolymers are the star copolymers such as Shellvis™ 200, Shellvis™ 260 and Shellvis™ 300. These high molecular weight solid materials, may conveniently be blended into lubricants in the form of a solution of the solid polymer in other basestock components. The amount of the high molecular weight thickener is typically from about 0.01 wt % to about 5 wt % of the total lubricant, more usually from about 0.1 wt % to about 3 wt % of the total lubricant composition, depending upon the viscosity of the basestock components and the desired viscometrics, particularly with respect to the high-temperature grade requirements. For example, more widely cross-graded oils such as the 0W-40, 5W-50 and 10W-60 will normally require more of the high molecular weight polymer thickener than less widely cross-graded oils, for example 0W-20 and 10W-30 oils which will need little or none of this thickening material.

The types of high molecular weight polymers which may be used as thickeners or VI improvers is given by Klamann in *Lubricants and Related Products*, Verlag Chemie, Deerfield Beach, Fla.; ISBN 0-89573-177-0. Reference is also made to "*Lubricant Additives*" by M. W. Ranney, published by Noyes Data Corporation of Parkridge, N.J. (1973).

Performance Additives

The present lubricant compositions also include one or more performance additives to impart or enhance the desired performance properties of the finished oil. These additives and the overall package will generally be conventional in type. The types of additives which may normally be used include, for example, the following: (1) oxidation inhibitors, (2) dispersants, (3) detergents, (4) corrosion inhibitors, (5) metal deactivators, (6) anti-wear agents, (7) extreme pressure additives, (8) pour point depressants, (9) viscosity index improvers (VII), (10) seal compatibility agents, (11) friction modifiers, (12) defoamants, etc. These general component descriptions illustrate, but do not limit, the types and numbers of lubricant performance components which may be used in the formulated lubes of this invention.

Oxidative stability is provided by the use of antioxidants and for this purpose a wide range of commercially available materials is available, as noted by Klamann op cit. The most common types are the phenolic antioxidants and the amine type antioxidants. They may be used individually by type or in combination with one another.

The phenolic antioxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_6$+ alkyl groups and the alkylene coupled derivatives of these hindered phenols. Examples of phenolic materials of this type inlcude: 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-di-t-butyl-4-heptyl phenol; and 2-methyl-6-di-t-butyl-4-dodecyl phenol. Examples of ortho coupled phenols include: 2,2'-bis(6-t-butyl-4-heptyl phenol); 2,2'-bis(6-t-butyl-4-octyl phenol); and 2,2'-bis(6-t-butyl-4-dodecyl phenol).

Non-phenolic oxidation inhibitors which may be used include the aromatic amine antioxidants and these may be used either as such or in combination with the phenolics. Typical examples of non-phenolic antioxidants include: alkylated and non-alkylated aromatic amines such as the aromatic monoamines of the formula $R^3R^4R^5N$ where $R^3$ is an aliphatic, aromatic or substituted aromatic group, $R^4$ is an aromatic or a substituted aromatic group, and $R^5$ is H, alkyl, aryl or $R^6S(O)_xR^7$ where $R^6$ is an alkylene, alkenylene, or aralkylene group, $R^7$ is a higher alkyl group, or an alkenyl, aryl, or alkaryl group, and x is 0, 1 or 2. The aliphatic group $R^3$ may contain from 1 to about 20 carbon atoms, and preferably contains from 6 to 12 carbon atoms. The aliphatic group is a saturated aliphatic group. Preferably, both $R^3$ and $R^4$ are aromatic or substituted aromatic groups, and the aromatic group may be a fused ring aromatic group such as naphthyl. Aromatic groups $R^3$ and $R^4$ may be joined together with other groups such as S.

Typical aromatic-amine antioxidants have alkyl substituent groups of at least 6 carbon atoms. Examples of aliphatic groups include hexyl, heptyl, octyl, nonyl, and decyl. Generally, the aliphatic groups will not contain more than 14 carbon atoms. The general types of amine antioxidants useful in the present compostions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present invention include: p,p'-dioctyldiphenylamine; octylphenyl-beta-naphthylamine; t-octylphenyl-alpha-naphthylamine; phenyl-alpha-naphthylamine; phenyl-beta-naphthylamine; p-octylphenyl-alpha-naphthylamine; 4-octylphenyl-1-octyl-beta-naphthylamine.

Normally, the total amount of antioxidants will not exceed 4 wt % of the total lubricant composition and normally is below about 3 wt %, typically from about 0.1 wt % to about 2 wt %.

Dispersants are also a known group of functional additives for lubricating oils, being used to maintain oxidation products in suspension in the oil, preventing accumulations of debris which could score bearings, block oilways and cause other types of damage as well as preventing deposit formation and inhibiting corrosive wear by the neutralization of acidic combustion products. Dispersants may be ash-containing or ashless in character. Chemically, many dispersants may be characterized as phenates, sulfonates, sulfurized phenates, salicylates, naphthenates, stearates, carbamates, thiocarbamates, and/or phosphorus derivatives. A particularly useful class of dispersants are the alkenylsuccinic derivatives, typically produced by the reaction of a long chain substituted alkenyl succinic compound, usually a substituted succinic anhydride, with a polyhydroxy or polyamino compound. The long chain group constituting the oleophilic portion of the molecule which confers solubility in the oil, is often a polyisobutylene group. Many examples of this type of dispersant are well known commercially and in the literature. Exemplary U.S. patents describing such disperants are U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in EP 471 071, to which reference is made for this purpose.

Detergents are also important additive components, serving to maintain overall cleanliness. Chemically, many detergents are similar to the dispersants as noted by Klamann and Ranney op cit. Ranney discloses a number of overbased metal salts of various sulfonic acids which are useful as detergents/dispersants in lubricants. The book entitled "*Lubricant Additives*," C. V. Smallheer and R. K. Smith, published by the Lezius-Hiles Co. of Cleveland, Ohio (1967), similarly discloses a number of overbased sulfonates which are useful as dispersants/detergents, and such disclosure is incorporated herein by reference. Examples of detergents may include, without limitation, the ashless or metal containing salts of phenates, sulfonates, sulfurized phenates, salicylates, naphthenates, stearates, carbamates, thiocarbamates, and/or phosphorus derivatives.

Corrosion inhibitors or metal deactivatiors are not normally required in the present compositions but may be optionally added, depending on the type of metals to be encountered in operation. A wide variety of these are commercially available and are referred to also in Klamann, op. cit.

The antiwear agents and extreme pressure additives may be ash-containing or ashless in character. For example, certain ash-containing antiwear agents, typified by zinc dialkyl dithiophosphates such as zinc di(iso-hexyl) dithiophosphate, may be added as needed to the present lubricant compositions. Similarly, extreme pressure additives, exemplified by various sulfur-containing materials such as dimercaptothiadiazole, may also be used in the present lube formulations. The additional wear protection effect of such additives is desirable in preserving the engineering integrity of mechanical components operating under severe service conditions of high temperature and high load.

Pour point depressants, generally polymer-type materials, may be added as desired. These types of additives are described in Klamann, op cit. However, the wax isomerate basestocks described herein have a significant advantage in having sufficiently low pour points that added pour point depressants are not usually required. Thus, the low-pour wax isomerate basestocks offer an unexpected formulation advantage in simplyfying a performance additive system, and in avoiding potentially antagonistic interactions and incompatibilities among the several polymeric additives, such as dispersants and viscosity modifier polymers, that might be used in combination.

Seal compatibility agents may be required as the highly paraffinic nature of the primary basestocks generally makes it necessary to use this additive to meet seal compatibility specifications. Additives of this type are commercially available, for example, as various aromatic esters, and may be used in conventional amounts, typically from about 0.1 to about 5 wt % of the total lubricant, usually from about 0.5 to about 2 wt %, depending on the particular basestock composition.

The friction modifiers (friction reducing agents) are a desirable class of additives and again, are commercially available as various fatty acid and/or ester derivatives. They also are described in Klamann, op cit. Glycerol esters such as the glycerol mono-oleates are often a preferred class of friction modifiers for the present lubricants; they are suitably used in an amounts from about 0.01 to about 2 wt % of the total lubricant. Alternate types of friction modifiers which may be used in the formulations of this invention are metal-containing friction modifiers, for example various molybdenum salts or complexes with functional groups such as dithiophosphates, dithiocarbamates, alcohols, amines, esters, and amides. Boron-containing friction modifiers with a similar array of functional groups, as cited above, may also be successfully used in such lubricant formulations. Effective amounts of metal-containing friction modifier additives may range from about 0.01 wt % to about 2 wt %.

Defoamants, typically silicone compounds, are commercially available and may be used in conventional minor amounts. Similarly, minor amounts of demulsifiers, for example oligomeric/polymeric ether-containing compounds, may also be used. Treat rates for these two types of additives (individually or combined) are typically less than about 1 percent and often less than about 0.1 percent.

Wax Isomerate Composition and Physical Properties

EXAMPLES

In the following examples regarding wax isomerate lube basestocks, hydroisomerization and catalytic dewaxing reaction conditions were varied to obtain the desired products, with typical conditions ranging from, but not limited to, 200–370° C., 400–2000 psig, 0.50–2.0 $hr^{-1}$ LHSV, and 1900–5000 scf/B (standard cubic feet per barrel) $H_2$ at the reactor inlet.

Examples 1–4

A hydrogenated Fischer-Tropsch wax (Paraflint 80) was hydrodewaxed in the presence of hydrogen over a combination of Pt/zeolite Beta hydroisomerization catalyst and Pt/ZSM-23 selective dewaxing catalyst. Four different hydrocarbon fluids were obtained under increasingly severe processing conditions, having KV (kinematic viscosity), VI (viscosity index) and PP (pour point) values as indicated in Table 3. Example 4 is an example of the primary basestock component of the present invention (Table 3).

Examples 5 and 6

A hydrogenated and partially isomerized Middle Distillate Synthesis Waxy Raffinate (Shell MDS or "SMDS") was hydrodewaxed in the presence of hydrogen over the combination of catalysts used in Examples 1–4. Two different hydrocarbon fluids were obtained under increasingly severe processing conditions, having KV, VI and PP values as indicated in Table 3. Example 6 is an example of the primary basestock component of the present invention.

Examples 7–9

The Shell MDS feedstock of Examples 5 and 6 was hydrodewaxed over synthetic ferrierite in the presence of hydrogen, under varying severity conditions to produce three different hydrocarbon fluids, having KV, VI and PP values as indicated in Table 3. Examples 7–9 are all examples of the primary basestock component of the present invention.

Example 10

The waxy feedstock used in Examples 1–4 was hydrodewaxed over Pt/ZSM-48 in the presence of hydrogen to produce a hydrocarbon fluid having the KV, VI and PP values indicated in Table 3. Example 10 is an example of the primary basestock component of the present invention.

Comparative Examples 1, 2, and 6

Commercially prepared polyalphaolefin basestocks of 3.87 cSt and 5.51 cSt KV at 100° C. are characterized by pour points of <−65° C. and VI's of 130 (Comparative Example 1) and 135 (Comparative Example 2), respectively. A commercial, higher viscosity grade of polyalphaolefin, 150 cSt KV at 100° C., is also included (Comparative Example 6). See Table 3.

Comparative Examples 3–5

Several commercially prepared basestocks derived from hydrocracked crude oil fractions were also evaluated (Table 3). These included: a −18° C. pour point, 5.1 cSt KV@100° C., 147 VI Shell XHVI basestock derived from hydroisomerization of slackwax (Comparative Example 3); a 4.0 cSt KV@100° C., 114 VI Yukong 100N basestock, characterized by a pour point of −15C (Comparative Example 4); and a 6.9 cSt KV@100° C., 102 VI Chevron RLOP 240N basestock, also characterized by a pour point of −15° C. (Comparative Example 5).

Comparative Example 7

Based on the art described in EP 0776959 A2, C80 Fischer-Tropsch wax feedstock was hydroisomerized at 399° C. over Ni4352 catalyst, at 2000 psig, 1.28 $hr^{-1}$ LHSV (i.e., 1.00 kg/L/hr), and 6600 scf/B (i.e., 1500 Nl/kg) $H_2$ at the reactor inlet, followed by distillation and solvent dewaxing of the 390C+ fraction to give overall 48% yield of a lubricant basestock with the following properties: −17° C. pour point, 5.68 cSt KV@100° C., 156 VI (Table 3). The Ni4352 catalyst is Ni/W on a flourided alumina support containing 8 wt % NiO, 24 wt % $WO_6$, 3 wt % F, 1 wt % $SiO_2$ and 64 wt % $Al_2O_3$. Compositional analysis of the resulting fluid gave the following branching characteristics: branching index (BI) of 24.8, and branching proximity ($CH_2$>4) of 25.1. Comparative example 7 falls outside the compositional space defined by equations (a) and (b) above for the primary wax isomerate basestocks described in the present invention.

Typical physical properties of various commercial lube basestocks are compared with those of the ULPP (ultra-low pour point) FT (Fischer-Tropsch) wax isomerates in Table 3, below.

TABLE 3

BASESTOCK PROPERTIES

| Description | Kinematic Viscosity @ 100° C. (cSt) | Viscosity Index | Pour Point (° C.) |
|---|---|---|---|
| Paraflint C80 Wax (Feed) | 9.42 | — | 83 |
| Ex. 1 | 7.14 | 177 | 12 |
| Ex. 2 | 6.52 | 171 | −3 |
| Ex. 3 | 5.72 | 161 | −24 |
| Ex. 4* | 5.54 | 145 | −63 |

TABLE 3-continued

BASESTOCK PROPERTIES

| Description | Kinematic Viscosity @ 100° C. (cSt) | Viscosity Index | Pour Point (° C.) |
|---|---|---|---|
| SMDS Waxy Raffinate (Feed) | 5.07 | — | 39 |
| Ex. 5 | 5.23 | 142 | −24 |
| Ex. 6* | 5.11 | 130 | −66 |
| Ex. 7* | 5.33 | 149 | −18 |
| Ex. 8* | 5.23 | 136 | −59 |
| Ex. 9* | 5.46 | 144 | −40 |
| Ex. 10* | 7.90 | 157 | −42 |
| Comparative Examples | | | |
| C.E. 1 | 3.87 | 130 | <−65 |
| C.E. 2 | 5.51 | 135 | <−65 |
| C.E. 3 | 5.06 | 147 | −18 |
| C.E. 4 | 4.00 | 114 | −15 |
| C.E. 5 | 6.94 | 102 | −15 |
| C.E. 6 | 150 | 214 | −42 |
| C.E. 7 | 5.68 | 156 | −17 |

*Examples of the primary basestock component of the present invention

FIG. 1 is a comparison of the Cold Crank Simulation (CCS) performances of a typical hydroprocessed hydrocarbon lube basestock (XHVI) and two basestocks according to the present invention. CCS testing was conducted according to ASTM method D5392, which is used to measure the apparent viscosity of motor oils. The CCS viscometer measures the dynamic viscosity of fluids at low temperature and at high shear rate and stress, thus simulating the resistance to flow of oil in an engine crankcase at low temperature under starting (cranking) conditions. The data of FIG. 1 demonstrates that the lubricant basestocks of the present invention have superior low temperature viscometric properties.

Measurement of Branching Characteristics

Branching Index (BI)

For each basestock indicated in Table 3, 359.88 MHz H solution NMR spectra were obtained on a Bruker 360 MHz AMX spectrometer using 10% solutions in $CDCl_3$. TMS was the internal chemical shift reference. $CDCl_3$ solvent gives a peak located at 7.28 ppm. All spectra were obtained under quantitative conditions using 90 degree pulse (10.9 μs), a pulse delay time of 30 s, which is at least five times the longest hydrogen spin-lattice relaxation time ($T_1$), and 120 scans to ensure good signal-to-noise ratios.

H atom types were defined according to the following regions:

9.2–6.2 ppm hydrogens on aromatic rings;

6.2–4.0 ppm hydrogens on olefinic carbon atoms;

4.0–2.1 ppm benzylic hydrogens at the α-position to aromatic rings;

2.1–1.4 ppm paraffinic CH methine hydrogens;

1.4–1.05 ppm paraffinic $CH_2$ methylene hydrogens;

1.05–0.5 ppm paraffinic $CH_3$ methyl hydrogens.

The branching index (BI) was calculated as the ratio in percent of non-benzylic methyl hydrogens in the range of 0.5 to 1.05 ppm, to the total non-benzylic aliphatic hydrogens in the range of 0.5 to 2.1 ppm. Results from these $^1H$ NMR analyses are summarized in Table 4 below.

TABLE 4

% Different Types of H from $^1$H NMR

| Description | % $CH_3$ | % $CH_2$ | % CH | BI |
|---|---|---|---|---|
| Paraflint C80 Wax (Feed) | | | | |
| Ex. 1 | 19.4 | 78.5 | 2.1 | 19.4 |
| Ex. 2 | 22.3 | 76.0 | 1.7 | 22.3 |
| Ex. 3 | 25.6 | 71.8 | 2.6 | 25.6 |
| Ex. 4* | 27.6 | 68.1 | 4.3 | 27.6 |
| SMDS Waxy Raffinate (Feed) | 10.3 | 89.7 | 0.0 | 10.3 |
| Ex. 5 | 23.6 | 70.1 | 6.3 | 23.6 |
| Ex. 6* | 29.8 | 67.8 | 2.4 | 29.8 |
| Ex. 7* | 26.2 | 71.2 | 2.6 | 26.2 |
| Ex. 8* | 30.0 | 67.0 | 3.0 | 30.0 |
| Ex. 9* | 27.9 | 69.9 | 2.2 | 27.9 |
| Ex. 10* | 27.0 | 70.8 | 2.2 | 27.0 |
| Comparative Examples | | | | |
| C.E. 1 | 22.7 | 74.8 | 2.5 | 22.7 |
| C.E. 2 | 23.4 | 74.3 | 2.3 | 23.4 |
| C.E. 3 | 26.9 | 69.4 | 3.7 | 26.9 |
| C.E. 4 | 30.0 | 61.9 | 8.1 | 30.0 |
| C.E. 5 | 31.5 | 55.3 | 13.2 | 31.5 |
| C.E. 6 | 19.4 | 78.7 | 1.9 | 19.4 |
| C.E. 7 | 24.8 | 73.5 | 1.7 | 24.8 |

*Examples of the primary basestock component of the present invention

Branching Proximity ($CH_2$>4)

For each basestock indicated in Table 3, 90.5 MHz $^{13}$C NMR single pulse and 135 Distortionless Enhancement by Polarization Transfer (DEPT) NMR spectra were obtained on a Bruker 360 MHz AMX spectrometer using 10% solutions in $CDCl_3$. TMS was the internal chemical shift reference. $CDCl_3$ solvent gives a triplet located at 77.23 ppm in the $^{13}$C spectrum. All single pulse spectra were obtained under quantitative conditions using 45 degree pulses (6.3 μs), a pulse delay time of 60 s, which is at least five times the longest carbon spin-lattice relaxation time ($T_1$), to ensure complete relaxation of the sample, 200 scans to ensure good signal-to-noise ratios, and WALTZ-16 proton decoupling.

The C atom types $C_3$, $CH_2$, CH were identified from the 135 DEPT $^{13}$C-NMR experiment. A major $CH_2$ resonance in all $^{13}$C NMR spectra at ~29.8 ppm is due to equivalent recurring methylene carbons which are four or more removed from an end group or branch; the percentage of such methylene carbons relative to all carbon types is the branching proximity, $CH_2$>4. The types of branches were determined based primarily on the $^{13}$C chemical shifts for the methyl carbon at the end of the branch or the methylene carbon one removed from the methyl on the branch. The proximity of branches, as indicated by $CH_2$>4, and the type of carbons are summarized in Table 5.

TABLE 5

% Different Types of C from $^{13}$C NMR

| Description | % $CH_3$ | % $CH_2$ | % CH | $CH_2$ > 4 |
|---|---|---|---|---|
| Paraflint C80 Wax (Feed) | | | | |
| Ex. 1 | 13.6 | 81.3 | 5.1 | 38.2 |
| Ex. 2 | 15.7 | 78.6 | 5.7 | 28.8 |
| Ex. 3 | 17.3 | 76.3 | 6.3 | 22.5 |
| Ex. 4* | 18.0 | 75.5 | 6.5 | 14.7 |
| SMDS Waxy Raffinate (Feed) | 6.2 | 93.8 | 0 | 58.8 |
| Ex. 5 | 16.6 | 77.3 | 6.0 | 17.3 |
| Ex. 6* | 24.9 | 67.4 | 7.7 | 7.7 |
| Ex. 7* | 16.4 | 77.5 | 6.1 | 21.8 |
| Ex. 8* | 19.3 | 75.1 | 5.6 | 12.8 |
| Ex. 9* | 18.1 | 76.3 | 5.6 | 17.7 |
| Ex. 10* | 15.9 | 76.3 | 7.7 | 20.5 |

TABLE 5-continued

% Different Types of C from $^{13}$C NMR

| Description | % $CH_3$ | % $CH_2$ | % CH | $CH_2$ > 4 |
|---|---|---|---|---|
| Comparative Examples | | | | |
| C.E. 1 | 11.4 | 83.7 | 4.9 | 20.4 |
| C.E. 2 | 13.2 | 81.0 | 5.8 | 20.6 |
| C.E. 3 | 19.0 | 74.3 | 6.7 | 22.6 |
| C.E. 4 | 16.7 | 72.3 | 11.0 | 20.4 |
| C.E. 5 | 16.5 | 62.0 | 21.5 | 19.2 |
| C.E. 6 | 12.3 | 83.9 | 3.8 | 17.3 |
| C.E. 7 | 15.9 | 79.3 | 4.8 | 25.1 |

*Examples of the primary basestock component of the present invention

The branching characteristics and pour points of the isoparaffinic components of the exemplary basestocks, as disclosed in Tables 3–5, are compared in the following Table 6.

TABLE 6

Comparison of Isoparaffinic Lube Compositions

| Description | BI | $CH_2$ > 4 | Pour Point, ° C. |
|---|---|---|---|
| Paraflint C80 Wax (Feed) | | | 83 |
| Ex. 1 | 19.4 | 38.2 | 12 |
| Ex. 2 | 22.3 | 28.8 | −3 |
| Ex. 3 | 25.6 | 22.5 | −24 |
| Ex. 4* | 27.6 | 14.7 | −63 |
| SMDS Waxy Raffinate (Feed) | 10.3 | 58.8 | 39 |
| Ex. 5 | 23.6 | 17.3 | −24 |
| Ex. 6* | 29.8 | 7.7 | −66 |
| Ex. 7* | 26.2 | 21.8 | −18 |
| Ex. 8* | 30.0 | 12.8 | −59 |
| Ex. 9* | 27.9 | 17.7 | −40 |
| Ex. 10* | 27.0 | 20.5 | −42 |
| Comparative Examples | | | |
| C.E. 1 | 22.7 | 20.4 | <−65 |
| C.E. 2 | 23.4 | 20.6 | <−65 |
| C.E. 3 | 26.9 | 22.6 | −18 |
| C.E. 4 | 30.0 | 20.4 | −15 |
| C.E. 5 | 31.5 | 19.2 | −15 |
| C.E. 6 | 19.4 | 17.3 | −42 |
| C.E. 7 | 24.8 | 25.1 | −17 |

*Examples of the primary basestock component of the present invention

The primary basestocks of the present invention can be differentiated from other hydrocarbon basestocks by the extent of branching as indicated by BI and the Branching Proximity as indicated by $CH_2$>4. These compositional fingerprints are graphed to aid in defining unique regions in this 2-dimensional composition space as illustrated in FIG. 2 (left quadrant).

From FIG. 2 it is clear that the branching characteristics of the primary isoparaffinic basestock compositions of the present invention are within a unique region. Specifically, the composition can be described as comprising mixtures of paraffinic hydrocarbon components in which the extent of branching, as measured by the percentage of methyl hydrogens (BI), and the proximity of branching, as measured by the percentage of recurring methylene carbons which are four or more removed from an end group or branch ($CH_2$>4), are such that:

$$BI-0.5\ (CH_2>4)>15;\ \text{and} \quad a)$$

$$BI+0.85\ (CH_2>4)<45. \quad b)$$

FIG. 3 is a comparison of the dynamic viscosities (DV@−40° C.), measured by the CCS method, and the kinematic viscosities (KV@100° C.) of various hydrocarbon fluids, including the primary basestock components of the present invention. The fluids of the present invention are indicated as "FTWI" (Fischer Tropsch Wax Isomerate), while several conventional hydrocracked stocks are indicated as "HDC." In particular, the HDC data points representing Comparative Examples 3–5 of the present specification are included. These viscosity data are listed in Table 7.

TABLE 7

High- and Low-Temperature Viscosity Relationship; Wax Isomerate vs Hydrocracked.

| Basestock Type | Pour Point (° C.) | KV100 (cSt) | CCS Viscosity @ −40° C. (cP) | BI | $CH_2$ > 4 | Within WI Lube Composition Space? |
|---|---|---|---|---|---|---|
| FTWI | −34 | 3.83 | 1940 | 29.9 | 16.8 | Yes |
| FTWI | −34 | 4.02 | 2520 | 29.9 | 16.1 | Yes |
| FTWI | −59 | 5.23 | 7770 | 30.0 | 12.8 | Yes |
| FTWI | −18 | 5.33 | 7290 | 26.2 | 21.8 | Yes |
| FTWI | −40 | 5.46 | 4500 | 27.9 | 17.7 | Yes |
| FTWI | −26 | 6.00 | 6630 | 26.9 | 19.2 | Yes |
| FTWI | −37 | 6.03 | 7360 | 28.2 | 17.9 | Yes |
| FTWI | −42 | 7.95 | 14960 | 27.0 | 20.5 | Yes |
| HDC | −18 | 5.06 | 11190 | 26.9 | 22.6 | No |
| HDC | −15 | 4.00 | 6400 | 30.0 | 20.4 | No |
| HDC | −15 | 6.94 | >23000 | 31.5 | 19.2 | No |
| HDC | −14 | 4.03 | 12700 | 31.5 | 15.9 | No |

It is clear from the data set forth in FIG. 3 that the FTWI fluids of the present invention have significantly improved low-temperature viscosity characteristics compared to that of conventional HDC fluids of the prior art. The solid line fits the viscosity trend of the FTWI basestocks of this invention, and the dotted line (parallel to the FTWI trend line) defines a boundary between the dynamic viscosity of the HDC oils and that of the FTWI oils. Note that all of the primary liquid hydrocarbon fluids of the present invention fall below the dotted line on the graph and can therefore be described by the following equation for dynamic viscosity (DV):

$$DV_{@-40^\circ C.} < 2900(KV_{@100^\circ C.}) - 7000.$$

Wax Isomerate Basestock Performance

Composition and Properties

Additional wax isomerate basestocks were used in discovering the unexpected performance advantages in formulated lubricants. Process conditions for hydroisomerization and catalytic dewaxing reactions for converting waxy feed stock into wax isomerate basestock are described above. These basestocks are listed in Table 8. All wax isomerates designated A, B, or C are examples of the primary basestock components of the present invention, and fall within the compositional space defined above, equations (a) and (b), using BI and $CH_2$>4 parameters. For comparison, conventional hydroprocessed basestocks Shell XHVI and Chevron UCBO (D-1, D-2), a high-pour point wax isomerate (D-3), and synthetic PAO4 (E-1) are listed, and fall outside of the basestock compositional space defined by equations (a) and (b).

TABLE 8

Lubricant Basestocks Composition and Physical Properties

| Basestocks* | Basestock Type | Pour Point (C.) | KV100 (cSt) | Viscosity Index | BI | $CH_2$ > 4 | Within WI Lube Composition Space? |
|---|---|---|---|---|---|---|---|
| A-1 | Wax Isomerate | −66 | 3.7 | 122 | 33.0 | 9.4 | Yes |
| A-2 | Wax Isomerate | −49 | 4.1 | 135 | 30.8 | 13.3 | Yes |
| A-3 | Wax Isomerate | −60 | 6.0 | 139 | 30.3 | 10.5 | Yes |
| A-4 | Wax Isomerate | −57 | 8.5 | 143 | 28.8 | 13.7 | Yes |
| A-5 | Wax Isomerate | −51 | 12.2 | 145 | 27.0 | 16.1 | Yes |
| B-1 | Wax Isomerate | −34 | 4.0 | 141 | 29.9 | 16.1 | Yes |
| B-2 | Wax Isomerate | −40 | 4.1 | 139 | 29.9 | 13.7 | Yes |
| B-3 | Wax Isomerate | −37 | 6.0 | 154 | 28.2 | 17.9 | Yes |
| B-4 | Wax Isomerate | −39 | 8.0 | 157 | 27.0 | 20.5 | Yes |
| C-1 | Wax Isomerate | −20 | 3.7 | 148 | 27.5 | 19.0 | Yes |
| C-2 | Wax Isomerate | −26 | 6.0 | 156 | 26.9 | 19.2 | Yes |
| D-1 | Chevron UCBO | −20 | 4.2 | 130 | 28.2 | 20.6 | No |
| D-2 | Shell XHVI | −18 | 4.0 | 143 | 25.8 | 24.7 | No |
| D-3 | Wax Isomerate | −18 | 6.0 | 164 | 25.4 | 21.5 | No |
| E-1 | PAO4 | −71 | 4.0 | 125 | 21.1 | 20.3 | No |

*Comments:
"A" represents WI oils with nominal pour points lower than about −45 C.
"B" represents WI oils with nominal pour points in the range of about −30 C. to −45 C.
"C" represents WI oils with nominal pour points higher than about −30 C.

Basestock Biodegradation Characteristics

The OECD and CEC biodegradation of various wax-isomerate basestocks and other types of basestocks were tested and results are tabulated in the following Table 9.

TABLE 9

Lubricant Basestock Biodegradability

| Base-stocks | Basestock Type | Pour Point (° C.) | KV100 (cSt) | % Biodegradability OECD 301B @ 28 days | % Biodegradability CEC L-33-A-93 @ 21 days |
|---|---|---|---|---|---|
| A-1 | Wax Isomerate | −66 | 3.7 | 54 | 74 |
| A-2 | Wax Isomerate | −49 | 4.1 | 61 | 90 |
| A-3 | Wax Isomerate | −60 | 6.0 | 55 | 51 |
| B-1 | Wax Isomerate | −34 | 4.0 | 65 | 98 |
| B-2 | Wax Isomerate | −40 | 4.1 | 65 | 90 |
| B-3 | Wax Isomerate | −37 | 6.0 | 67 | 90 |
| C-1 | Wax Isomerate | −20 | 3.7 | 72 | 100 |
| D-1 | RLOP UCBO | −20 | 4.2 | 34 | 82 |
| D-2 | Shell XHVI | −18 | 4.0 | 50 | 89 |
| E-1 | PAO4 | −71 | 4.0 | 30 | 37 |

In the very demanding OECD 301B test, the wax isomerates of the current invention attain greater than about 50% biodegradation.

Basestock Performance Characteristics

In the lubricant formulations defined in this invention, the wax isomerate basestocks described herein meet the compositions defined by equations (a) and (b), and additionally fall into preferred ranges of certain performance parameters such as pour point, MRV viscosity, and viscosity index. A series of WI basestocks of the present invention with differing pour points but with matching kinematic viscosity (6.0 cSt) at 100° C. are listed in Table 10. Other basestock performance properties include Viscosity Index, MRV viscosity, and CCS viscosity.

TABLE 10

Wax Isomerate Performance Properties vs Pour Point

| Basestock | Basestock Type | Pour Point (° C.) | KV100 (cSt) | Viscosity Index | MRV Viscosity @ −30° C. (cP); Yield Stress <35 Pa | CCS Viscosity @ −30° C. (cP) |
|---|---|---|---|---|---|---|
| A-3 | Wax Isomerate | −60 | 5.97 | 139 | 3060 | 3060 |
| B-3 | Wax Isomerate | −37 | 6.03 | 154 | 2730 | 2350 |
| C-2 | Wax Isomerate | −26 | 6.00 | 156 | 3050 | 2240 |
| D-3 | Wax Isomerate | −18 | 6.02 | 164 | 9210 | 2110 |

FIG. 4 is a comparison of the data presented in Table 10, including viscosity index (VI), mini-rotary viscometer (MRV) viscosity, and cold crank simulation (CCS) viscosity.

MRV testing was conducted according to ASTM method D4684. MRV testing is conducted by very slowly cooling down a lube with the resulting slow crystallization of the wax contained in the lube, followed by testing the wax matrix strength and lube viscosity under low energy, low shear conditions. Thus MRV measures the dynamic viscosity of a fluid at low temperature and at low shear rate and stress, under simulated pumping conditions.

CCS testing was conducted according to ASTM method D5392, which is used to measure the apparent viscosity of motor oils at low temperatures. CCS testing is conducted by rapidly cooling down a lube with resulting rapid precipitation of wax contained in the lube, followed by measuring the resistance to flow of the waxy lubricant under high energy, high shear conditions. Thus CCS measures the dynamic viscosity of fluids at low temperature and at high shear rate and stress, under conditions simulating engine starting (mechanical cranking).

The viscosity index (VI) is a measure of a fluid's retention of viscosity with increasing temperature; thus high VI fluids retain greater viscosity and do not thin out as quickly as low VI fluids do with increasing temperature.

The data of FIG. 4 demonstrates that the primary wax isomerate basestocks of the present invention should have pour points of about −25° C. or lower, at which point the combination of MRV viscosity and CCS viscosity (both measured at −30° C.) is lowest. Such a combination of these two low-temperature performance properties is highly advantageous in preparing fully-formulated wax isomerate-containing lubricants, and was not predictable based on the WI basestock compositions defined by equations (a) and (b). In addition, an upper limit to VI is realized, preferably at about 160.

Lubricant Formulations

In the following examples regarding formulations and finished lube performance properties, various passenger car engine oils (PCEO) are illustrated, using an additive package (PCEO DDI) having the proven capability of meeting the quality standards defined by API SJ (ASTM 4485; API Publication No. 1509, Appendix G), ILSAC GF2 (API Publication No. 1509, Appendix D), and ACEA A3/B3 (ACEA European Oil Sequences, September 1999, www.acea.be). The PCEO DDI additive package contains the following performance additives (typically used in engine oil formulations): dispersants, detergents, antiwears, antioxidants, seal compatibility additives, friction modifiers, and demulsifier/defoamants. The basestock mixture is also typical of high-quality PCEO's, specifically semi-synthetic or fully synthetic engine oils where a major amount of one or more highly paraffinic hydrocarbons (e.g. in this invention, WI basestocks) is used, in addition to optional minor amounts of one or more co-basestocks (e.g. esters, alkyl aromatics, etc.; to enhance as needed additive solubility, seal compatibility, or other basestock-related performance).

Formulated lubricants are prepared by combining all the basestock and additive components together, and heating the mixture to 70–90° C. with stirring for several hours until all components are dissolved and the mixture is completely homogeneous. Details of the specific formulations used for each of the Examples and Comparative Examples are listed in the associated Tables.

Several wax isomerate lubricant compositions at selected kinemetic viscosity at 100° C. and at selected pour point (Table 8) were formulated with an API SJ-quality additive package (PCEO DDI) as well as additional lubricating components to obtain examples of multi-grade passenger car engine oils. Formulation examples are listed below.

Examples 11–14

These examples (Table 11) include non-viscosity modified (non-VM) oils formulated with ultra low pour point (A-1) and low pour point (B-2, B-3, B-4) wax isomerates as the major paraffinic basestock component, to give multigrade (0W-20, 5W-20, and 10W-30) lubricants.

Examples 15–20

These examples (Tables 12–14) include polymer-modified oils formulated with selected wax isomerate basestocks from both A and B catagories (Table 8) as the major paraffinic basestock component, to give various multigrade lubricants.

Comparative Examples 8, 11–13

These comparative examples (Tables 11, 13, 14) include polymer-modified oils formulated with PAO synthetic basestock as the major paraffinic basestock component, to give various multigrade lubricants.

Comparative Examples 9, 10

These comparative examples (Table 12) include polymer-modified oils formulated with conventional hydroprocessed basestocks Shell XHVI (D-1) and Chevron UCBO (D-2) as the major paraffinic basestock component, to give various multigrade lubricants.

Table 11 shows examples of non-viscosity modified multigrade PCEO's. WI basestocks of this invention demonstrate the unexpected capability of formulating naturally crossgraded oils, as demonstrated by Examples 11 (SAE 0W-20), 12 (SAE 0W-20), 13 (SAE 5W-20) and 14 (SAE 10W-30). Multigrade oils formulated without viscosity modifier polymers (so called non-viscosity modified, or non-VM oils) have been only achieved with polyalphaolefins, for example with hydrogenated poly-1-decene as cited in U.S. Pat. No. 4,992,183. Compabable non-VM formulations have not been obtainable with conventionally hydroprocessed basestocks.

TABLE 11

Wax Isomerate Performance in Non-Viscosity Modified Formulations

| | Ex. 11 | Ex. 12 | Ex. 13 | Ex. 14 | C.E. 8 |
|---|---|---|---|---|---|
| Formulation Component, Wt. % | | | | | |
| Wax Isomerate A-1 | 64.1 | | | | |
| Wax Isomerate B-2 | | 64.1 | | | |
| Wax Isomerate B-3 | | | 64.1 | | |
| Wax Isomerate B-4 | | | | 64.1 | |
| Syn. Base Oil (PAO) | | | | | 64.1 |

TABLE 11-continued

Wax Isomerate Performance in Non-Viscosity Modified Formulations

| | Ex. 11 | Ex. 12 | Ex. 13 | Ex. 14 | C.E. 8 |
|---|---|---|---|---|---|
| Co-Base Oil (Ester/Aromatic) | 20.0 | 20.0 | 20.0 | 20.0 | 20.0 |
| PCEO DDI (Additives) | 15.9 | 15.9 | 15.9 | 15.9 | 15.9 |
| Performance | | | | | |
| SAE Viscosity Grade | 0W-20 | 0W-20 | 5W-20 | 10W-30 | 10W-30 |
| KV @ 100° C. (cSt) | 6.25 | 6.60 | 8.60 | 10.45 | 10.49 |
| CCS @ −20° C. (cP) | | | | 2800 | 3220 |
| CCS @ −25° C. (cP) | | | 3025 | | |
| CCS @ −30° C. (cP) | 2570 | 2490 | | | |
| HTHS @ 150° C. (cP) | 2.14 | 2.35 | 2.96 | 3.44 | 3.42 |
| Pour Point (° C.) | −54 | −51 | −45 | −51 | −54 |
| MRV @ −30° C. (cP/Pa) | | | | 8830/<35 | 10600/<35 |
| MRV @ −35° C. (cP/Pa) | | | 10100/<35 | | |
| MRV @ −40° C. (cP/Pa) | 9580/<35 | 8660/<35 | | | |

Table 12 lists examples which demonstrate that wax isomerate basestocks of this invention can meet the stringent viscosity requirements of low-viscosity multigraded oils, specifically SAE 0W-30, under formulation conditions where conventional hydroprocessed basestocks fail. Even though each example was prepared with an identical formulation, Example 15 successfully meets all viscometric targets for a 0W-30 multigrade oil, whereas Comparative Example 9 fails to meet the CCS viscosity requirement (3250 cP maximum at −30° C.), and Comparative Example 10 fails to meet the MRV viscosity requirement at −40° C. (60000 cP maximum, with yield stress <35 Pa).

TABLE 12

Wax Isomerate Performance in SAE Viscosity Grade 0W-30 Formulations

| | Ex. 15 | C.E. 9 | C.E. 10 |
|---|---|---|---|
| Formulation Component, Wt. % | | | |
| Styrene-Isoprene Polymer | 0.9 | 0.9 | 0.9 |
| Wax Isomerate B-1 | 54.7 | | |
| Chevron UCBO, D-1 | | 54.7 | |
| Shell XHVI, D-2 | | | 54.7 |
| Co-Base Oil (Ester/Aromatic/PAO) | 28.5 | 28.5 | 28.5 |
| PCEO DDI (Additives) | 15.9 | 15.9 | 15.9 |
| Performance | | | |
| SAE Viscosity Grade | 0W-30 | 5W-30 | 15W-30 |
| KV @ 100° C. (cSt) | 9.8 | 10.2 | 9.8 |
| CCS @ −30° C. (cP) | 2850 | 3860* | 3220 |
| HTHS @ 150° C. (cP) | 3.16 | 3.34 | 3.20 |
| Pour Point (° C.) | −46 | −31 | −22 |
| MRV @ −25° C. (cP/Pa) | | | 4800/<35 |

TABLE 12-continued

| Wax Isomerate Performance in SAE Viscosity Grade 0W-30 Formulations | Ex. 15 | C.E. 9 | C.E. 10 |
|---|---|---|---|
| MRV @ −30° C. (cP/Pa) | | | 162000/<70 |
| MRV @ −40° C. (cP/Pa) | 12500/<35 | 35600/<35 | Too viscous to measure* |

*Fails to meet target requirements for SAE 0W-30

Table 13 lists formulated oils of this invention demonstrating utility of the WI basestocks described herein as formulation components in low-viscosity, widely cross-graded oils, such as for example SAE 0W-40. Examples 16 and 18, formulated with WI basestocks A-1 (−66° C. pour point) and B-1 (−34° C. pour point), successfully meet the viscometric targets of SAE 0W-40, comparing favorably with the fully synthetic Comparative Example 11. Such performance cannot be attained by comparably formulated lubricants using conventionally hydroprocessed basestocks.

Additionally, in certain formulations such as for example SAE 0W-40, preferred WI basestocks may have higher pour points because of more advantageous (i.e. lower) CCS viscosity compared to WI basestocks with ultra low pour points. Examples 17 and Example 18 compare the performance of lubricants formulated with WI isomerate basestocks with essentially identical kinematic viscosity at 100° C., nominal 4 cSt, but differing in pour point, −49° C. pour (A-2 basestock) versus −34° C. pour (B-1 basestock), respectively. Example 18, containing the higher pour B-1, meets the target viscometrics for SAE 0W-40. By comparison Example 17, containing the lower pour A-1, fails to meet the low-temperature CCS viscosity target for SAE 0W-40 grade. Alternatively, very low pour point WI basestocks may be used in such cases, however, as in Example 16 using A-1 (3.7 cSt, and −66° C. pour point), but the usable WI basestocks have lower kinematic viscosity at 100C to compensate for its higher CCS viscosity. Lowering kinematic viscosity may balance CCS requirements, but could cause other potentially undesirable changes, such as for example increasing basestock volatility.

TABLE 13

| Wax Isomerate Performance in SAE Viscosity Grade 0W-40 Formulations | Example 16 | Example 17 | Example 18 | Comp. Ex. 11 |
|---|---|---|---|---|
| Formulation Component, Wt. % | | | | |
| Styrene-Isoprene Polymer | 1.4 | 1.4 | 1.4 | 1.6 |
| Wax Isomerate A-1 | 62.7 | | | |
| Wax Isomerate A-2 | | 62.7 | | |
| Wax Isomerate B-1 | | | 62.7 | |
| Syn. Base Oil (PAO) | | | | 62.5 |
| Co-Base Oil (Ester/Aromatic) | 20.0 | 20.0 | 20.0 | 20.0 |
| PCEO DDI (Additives) | 15.9 | 15.9 | 15.9 | 15.9 |
| Performance | | | | |
| SAE Viscosity Grade | 0W-40 | 5W-40 | 0W-40 | 0W-40 |
| KV @ 100° C. (cSt) | 12.7 | 13.5 | 13.5 | 14.1 |
| CCS @ −30° C. (cP) | 3150 | 3340* | 2800 | 3100 |
| HTHS @ 150° C. (cP) | 3.54 | 3.75 | 3.70 | 3.72 |

TABLE 13-continued

| Wax Isomerate Performance in SAE Viscosity Grade 0W-40 Formulations | Example 16 | Example 17 | Example 18 | Comp. Ex. 11 |
|---|---|---|---|---|
| Pour Point (° C.) | −56 | −51 | −48 | −60 |
| MRV @ −40° C. (cP/Pa) | 18370/<35 | 20000/<35 | 16800/<35 | 18000/<35 |

*Fails to meet target requirements for SAE 0W-40

Table 14 lists formulated oils demonstrating the use of WI isomerate basestocks in attaining alternate engine oil multigrades, such as for example SAE 15W-50 and SAE 5W-50. Both A-type WI basestocks, as in Example 19, and B-type WI basestocks, as in Example 20, can be used in such formulations.

TABLE 14

| Wax Isomerate Performance in SAE Viscosity Grade 15W-50, 5W-50 Formulations | Example 19 | Example 20 | C.E. 12 | C.E. 13 |
|---|---|---|---|---|
| Formulation Component, Wt. % | | | | |
| Styrene-Isoprene Polymer | 1.0 | 2.0 | 1.25 | 2.0 |
| Wax Isomerate A-3 | 9.5 | | | |
| Wax Isomerate A-4 | 36.4 | | | |
| Wax Isomerate A-5 | 17.2 | | | |
| Wax Isomerate B-2 | | 43.1 | | |
| Wax Isomerate B-3 | | 19.0 | | |
| Wax Isomerate B-4 | | | | |
| Syn. Base Oil (PAO) | | | 62.85 | 62.1 |
| Co-Base Oil (Ester/Aromatic) | 20.0 | 20.0 | 20.0 | 20.0 |
| PCEO DDI (Additives) | 15.9 | 15.9 | 15.9 | 15.9 |
| Performance | | | | |
| SAE Viscosity Grade | 15W50 | 5W-50 | 15W-50 | 5W-50 |
| KV @ 100° C. (cSt) | 17.8 | 21.5 | 18.0 | 20.7 |
| CCS @ −15° C. (cP) | 2660 | | 2390 | |
| CCS @ −25 C. (cP) | | 2580 | | 2500 |
| HTHS @ 150° C. (cP) | 4.97 | 4.90 | 5.05 | 4.74 |
| Pour Point (° C.) | −51 | −48 | −48 | −54 |
| MRV @ −25° C. (cP/Pa) | 11200/<35 | | 10100/<35 | |
| MRV @ −35° C. (cP/Pa) | | 18300/<35 | | 16500/<35 |

Table 15 demonstrates the advantageous biodegradability of a fully formulated wax isomerate lubricant versus a comparable fully formulated PAO lubricant. This confirms that the superior biodegradability of wax isomerate base oils relative to PAO base 5 oil (Table 9) translates into a significant advantage in wax-isomerate containing formulated lubricants.

TABLE 15

| Biodegradation of Wax Isomerate SAE 0W-40 Formulation | Example 18 | Comp. Ex. 11 |
|---|---|---|
| Formulation Component, Wt. % | | |
| Styrene-Isoprene Polymer | 1.4 | 1.6 |
| Wax Isomerate B-1 | 62.7 | |
| Syn. Base Oil (PAO) | | 62.5 |
| Co-Base Oil (Ester/Aromatic) | 20.0 | 20.0 |
| PCEO DDI (Additives) | 15.9 | 15.9 |

TABLE 15-continued

Biodegradation of Wax Isomerate SAE 0W-40 Formulation

| | Example 18 | Comp. Ex. 11 |
|---|---|---|
| Performance | | |
| SAE Viscosity Grade | 0W-40 | 0W-40 |
| % Biodegradability: | | |
| OECD 301B @ 28 days | 53 | 21 |
| CEC L-33-A-93 @ 21 days | 71 | 45 |

Although the invention has been described in detail and with reference to specific embodiments thereof, it will be apparent to one skilled in the art that various changes and modifications can be made therein without departing from the scope and spirit of the present invention.

The invention claimed is:

1. A liquid lubricant composition, comprising (i) a paraffinic biodegradable hydrocarbon basestock component having a biodegradability of at least 50% (OECD 301B) and having a pour point of from about −25° C. to −55° C. and a viscosity index of 130 to 160, in which the extent of branching, as measured by the percentage at methyl hydrogens (BI), and the proximity of branching, as measured by the percentage of recurring methylene carbons which are four or more carbons removed from an end group or branch ($CH_2$>4), are such that;

$$BI-0.5(CH_2>4)>15: \text{ and} \quad (a)$$

$$BI+0.85(CH_2>4)<45; \quad (b)$$

as measured Over said hydrocarbon basestock as a whole, and (ii) additives soluble in the basestock comprising a detergent and an antioxidant, the liquid lubricant composition having a CCS viscosity at −15° C. of not more than about 3500 cP and a kinematic viscosity at 100° C. of not less than about 5 cSt.

2. The liquid lubricant composition of claim 1, wherein a combination of dynamic viscosity (DV), as measured by CCS viscosity at −40° C., and kinematic viscosity, as measured at 100° C., of said paraffinic biodegradable hydrocarbon basestock is:

$$DV_{@-40°\,C.}<2900(KV_{@100°C.})-7000.$$

3. The liquid lubricant composition of claim 1, wherein MRV viscosity as measured at −30° C. of said paraffinic biodegradable hydrocarbon basestock is not more than about 60,000 cP, with a yield stress of not more than about 35 cP.

4. The liquid lubricant composition of claim 3, wherein MRV viscosity as measured at −40° C. of said paraffinic biodegradable hydrocarbon basestock is not more than about 60,000 cP, with a yield stress of not more than about 35 cP.

5. The liquid lubricant composition of claim 1, wherein the viscosity index of said paraffinic biodegradable hydrocarbon basestock is from about 140 to about 160.

6. The liquid lubricant composition of claim 1, wherein the pour point of said paraffinic biodegradable hydrocarbon basestock is less than about −30° C.

7. The liquid lubricant composition of claim 6, wherein MRV viscosity as measured at −35° C. of said paraffinic biodegradable hydrocarbon basestock is not more than about 60,000 cP, with a yield stress of not more than about 35 cP.

8. The liquid lubricant composition of claim 6, wherein viscosity index of said paraffinic biodegradable hydrocarbon basestock is from about 140 to about 160.

9. The liquid lubricant composition of claim 6, wherein the pour point of said paraffinic biodegradable hydrocarbon basestock is from about −30° C. to about −45° C.

10. The liquid lubricant composition of claim 1, wherein the pour point of said lubricant composition is less than about −20° C.

11. The liquid lubricant composition of claim 10, wherein the pour point of said lubricant composition is less than about −30° C.

12. The liquid lubricant composition of claim 10, wherein the pour point of said lubricant composition is from about −35° C. to about −60° C.

13. The liquid lubricant composition of claim 1 which conforms to SAE 0W low-temperature viscosity grading, and which has CCS viscosity at −30° C. of not more than 3250 cP, and MRV viscosity at −40° C. of not more than 60,000 cP.

14. The liquid lubricant composition of claim 13 further comprising a polymeric viscosity modifier.

15. The liquid lubricant composition of claim 14 which conforms to SAE 0W-40 grading and which has a kinematic viscosity at 100° C. of from 12.5 cSt to less than 16.3 cSt, comprising from about 0.05 to 30 wt % of the polymeric viscosity modifier and wherein the paraffinic biodegradable hydrocarbon basestock has a kinematic viscosity at 100° C. of from about 3.5 cSt to about 5.0 cSt.

16. The liquid lubricant composition of claim 15 having a pour point no higher than about −40° C.

17. The liquid lubricant composition of claim 14 which conforms to SAE 0W-30 grading and which has a kinematic viscosity at 100° C. of from 9.3 cSt to less than 12.5 cSt, comprising from about 0.01 to about 25 wt % of the polymeric viscosity modifier and wherein the paraffinic biodegradable hydrocarbon basestock has a kinematic viscosity at 100° C. of from about 3.5 to about 5.0 cSt.

18. The liquid lubricant composition of claim 17 having a pour point no higher than about −40° C.

19. The liquid lubricant composition of claim 18 having a CCS viscosity at −30° C. of not more than about 3000 cP.

20. The liquid lubricant composition of claim 1 which conforms to SAE 5W low-temperature viscosity grading, and which has CCS viscosity at −25° C. of not more than 3500 cP, and MRV viscosity at −35° C. of not more than 60,000 cP.

21. The liquid lubricant composition of claim 20 further comprising a polymeric viscosity modifier.

22. The liquid lubricant composition of claim 1 which conforms to SAE 10W low-temperature viscosity grading, and which has CCS viscosity at −20° C. of not more than 3500 cP, and MRV viscosity at −30° C. of not more than 60,000 cP.

23. The liquid lubricant composition of claim 22 further comprising a polymeric viscosity modifier.

24. The liquid lubricant composition of claim 1 which conforms to SAE 15W low-temperature viscosity grading, and which has CCS viscosity at −15° C. of not more than 3500 cP, and MRV viscosity at −25° C. of not more than 60,000 cP.

25. The liquid lubricant composition of claim 24 further comprising a polymeric viscosity modifier.

26. The liquid lubricant composition of claim 25 which conforms to SAE 15W-50 viscosity grading and which has a kinematic viscosity at 100° C. of from 16.3 cSt to less than 21.9 cSt, comprising from about 0.1 to about 25 wt % of the polymeric viscosity modifier and wherein the paraffinic biodegradable hydrocarbon basestock has a kinematic viscosity at 100° C. of from about 5.5 cSt to about 14.0 cSt.

27. The liquid lubricant composition of claim 26 having a pour point no higher than about −35° C.

28. The liquid lubricant composition of claim 27 having a CCS viscosity at −30° C. of not more than about 3300 cP.

29. The liquid lubricant composition of claim 1 which conforms to SAE "xW-y" viscosity grading, where x=0, 5, 10, or 15, and where y=10, 20, 30, or 40, and where (y−x) is less than or equal to 25.

30. The liquid lubricant composition of claim 1, wherein said paraffinic hydrocarbon components have BI greater than 26.1 and $CH_2$>4 less than 22.2.

31. The liquid lubricant composition of claim 1 further comprising a lubricating oil basestock component comprising an ester or an alkylated aromatic or mixtures thereof.

32. The liquid lubricant composition of claim 31 wherein the ester is an ester of a polyol alcohol and a monocarboxylic acid having a kinematic viscosity at 100° C. of about 2 cSt to about 8 cSt, and the alkylated aromatic is an alkyl naphthalene having a mono alkyl substituent group of about 10 to about 20 carbon atoms having a kinematic viscosity at 100° C. of about 2 cSt to about 8 cSt.

33. The liquid lubricant composition of claim 31 having from about 5 wt % to about 20 wt % of the ester or alkylated aromatic or mixture thereof.

34. The liquid lubricant composition of claim 1 wherein the antioxidant is an aromatic amine or an alkylated phenol or mixtures thereof.

35. The liquid lubricant composition of claim 1 wherein the detergent is an alkali or alkaline earth sulfonate, or an alkali or alkaline earth salicylate, or alkali or alkaline earth phenate, or mixtures thereof.

36. The liquid lubricant composition of claim 1 which conforms to SAE 0W-20 viscosity grading and which is formulated as a non-viscosity modified oil containing no viscosity modifier polymer, in which (i) the paraffinic biodegradable hydrocarbon basestock has a pour point from −30° to 45° C., a viscosity index from 130 to 140, (ii) the composition has a CCS (−30° C.) of not more than 3250 cP.

37. The liquid lubricant composition of claim 1 which conforms to SAE 5W-20 viscosity grading and which is formulated as a non-viscosity modified oil containing no viscosity modifier polymer, in which (i) the paraffinic biodegradable hydrocarbon basestock has a pour point from −30° to −45° C., a viscosity index from 130 to 140, (ii) the composition has a CCS (−25° C.) of not more than 3500 cP.

38. The liquid lubricant composition of claim 1 which conforms to SAE 10W-30 viscosity grading and which is formulated as a non-viscosity modified oil containing no viscosity modifier polymer, in which (i) the paraffinic biodegradable hydrocarbon basestock has a pour point from −30° to −45° C., a viscosity index from 130 to 140, (ii) the composition has a CCS (−20° C.) of not more than 3500 cP.

39. The liquid lubricant composition of claim 1 which conforms to SAE 0W-30 viscosity grading and which is formulated as a viscosity modified oil comprising viscosity modifier polymer, in which (i) the paraffinic biodegradable hydrocarbon basestock has a pour point from −30° to −45° C., a viscosity index from 130 to 140, (ii) the composition has a CCS (−30° C.) of not more than 3250 cP at −30C.

40. The liquid lubricant composition of claim 1 which conforms to SAE 5W-40 viscosity grading and which is formulated as a viscosity modified oil comprising viscosity modifier polymer, in which (i) the paraffinic biodegradable hydrocarbon basestock has a pour point from −30° to −45° C., a viscosity index from 130 to 140, (ii) the composition has a CCS (−25° C.) of not more than 3500 cP. 41.

41. The liquid lubricant composition of claim 1 which conforms to SAE 0W-40 viscosity grading and which is formulated as a viscosity modified oil comprising viscosity modifier polymer, in which (i) the paraffinic biodegradable hydrocarbon basestock has a pour point from −30 to −45° C., a viscosity index from 130 to 140, (ii) the composition has a CCS (−30C) of not more than 3250 cP.

42. The liquid lubricant composition of claim 1 which conforms to SAE 5W-50 viscosity grading and which is formulated as a viscosity modified oil comprising viscosity modifier polymer, in which (i) the paraffinic biodegradable hydrocarbon basestock has a pour point from −30° to −45° C., a viscosity index from 130 to 140, (ii) the composition has a CCS (−25° C.) of not more than 3500 cP.

* * * * *